US008158237B2

(12) United States Patent
Yamada et al.

(10) Patent No.: US 8,158,237 B2
(45) Date of Patent: Apr. 17, 2012

(54) HONEYCOMB STRUCTURE

(75) Inventors: Toshio Yamada, Nagoya (JP); Hideyuki Toyoshima, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 152 days.

(21) Appl. No.: 12/406,697

(22) Filed: Mar. 18, 2009

(65) Prior Publication Data

US 2009/0246454 A1 Oct. 1, 2009

(30) Foreign Application Priority Data

Mar. 25, 2008 (JP) ..... 2008-077636

(51) Int. Cl.

| | |
|---|---|
| ***B32B 3/12*** | (2006.01) |
| ***B01D 39/06*** | (2006.01) |
| ***B01D 45/00*** | (2006.01) |
| ***B01D 45/12*** | (2006.01) |

(52) U.S. Cl. ..... 428/116; 502/527.18; 55/523; 55/342; 55/348

(58) Field of Classification Search ..... None
See application file for complete search history.

(56) References Cited

U.S. PATENT DOCUMENTS

| | | | | |
|---|---|---|---|---|
| 3,982,100 | A * | 9/1976 | Hervert | 219/553 |
| 7,162,867 | B2 * | 1/2007 | Saito et al. | 60/295 |
| 2004/0074094 | A1 * | 4/2004 | Bruck | 29/890 |
| 2004/0159358 | A1 | 8/2004 | Bruck | |
| 2005/0022382 | A1 * | 2/2005 | Bruck et al. | 29/890 |
| 2005/0170957 | A1 | 8/2005 | Maus et al. | |
| 2006/0025729 | A1 | 2/2006 | Leiboff et al. | |
| 2007/0242728 | A1 | 10/2007 | Althofer et al. | |
| 2008/0011054 | A1 | 1/2008 | Althofer et al. | |

FOREIGN PATENT DOCUMENTS

| | | |
|---|---|---|
| DE | 10 2004 053 460 A1 | 5/2006 |
| JP | A-2003-225576 | 8/2003 |
| JP | A-2004-526564 | 9/2004 |
| JP | A-2006-320888 | 11/2004 |
| JP | A-2005-526625 | 9/2005 |
| JP | A-2005-535454 | 11/2005 |
| JP | A-2008-519272 | 6/2008 |
| WO | WO 02/075125 A1 | 9/2002 |
| WO | WO 2006/084742 A1 | 8/2006 |

* cited by examiner

*Primary Examiner* — Gordon R Baldwin
(74) *Attorney, Agent, or Firm* — Oliff & Berridge, PLC

(57) ABSTRACT

A precise exhaust gas control can be achieved without being influenced by fluctuations of the excess air ratio (λ) between cylinders of engines or the size of the diameter (the sectional area) of the honeycomb structure. The honeycomb structure is formed by a plurality of cells separated from one another by porous partition walls and functioning as fluid flow paths, the honeycomb structure includes: a sensor plug-in hole 7 which is formed in an outer peripheral surface 4 of the honeycomb structure and into which a sensor can be plugged, and the sensor plug-in hole 7 is provided with at least one deep hole 8 which communicates with the sensor plug-in hole.

13 Claims, 11 Drawing Sheets

HONEYCOMB STRUCTURE

BACKGROUND OF THE INVENTION AND RELATED ART STATEMENT

The present invention relates to a honeycomb structure provided with a plug-in hole for a sensor.

To prevent environmental pollution and improve the environment, a catalyst converter is used for the treatment of an exhaust gas from automobiles. This catalyst converter converts harmful substances (nitrogen oxide, carbon monoxide, hydrocarbon, etc.) contained in the exhaust gas into components and/or the amount dischargeable to the environment in accordance with law regulations. When the exhaust gas passes through the catalyst converter, the harmful substances contained in the gas are decreased.

However, to confirm whether the harmful substances have actually been decreased or not, it is difficult to directly measure the concentration of the harmful substances in the exhaust gas by use of a sensor.

To solve the problem, the function of the catalyst converter is monitored instead. If the catalyst converter functions, the harmful substances must be decreased. When the function of the catalyst converter is monitored, there is adopted a means where oxygen sensors are disposed before and after the catalyst converter, respectively, and the content of oxygen in the exhaust gas is measured by use of these sensors to estimate the accumulation capacity of the catalyst and the proceeding of an aging process. Alternatively, there is adopted a means where heat sensors are disposed before and after the catalyst converter, respectively, and the temperature changes of the exhaust gas are measured by use of these sensors to predict whether the catalyst converter works or not (e.g., Japanese Patent Publication No. 2004-526564).

When the above sensor cannot be installed on the upstream side of the catalyst converter owing to space restriction or the like, heretofore a constitution has been adopted in which a hole is formed in a honeycomb structure of the catalyst converter to insert the sensor into the hole. The honeycomb structure including the sensor is installed in an exhaust system of the automobile (hereinafter appropriately referred to as "the conventional honeycomb structure"). Moreover, such a conventional honeycomb structure intends to cope with the space restriction.

However, this conventional honeycomb structure cannot sample any gas from portions other than the hole for the sensor. Furthermore, an only part of the exhaust gas selectively flows into the sensor (the measurement point of the sensor). Therefore, an engine cannot be controlled with an excess air ratio ($\lambda$)=1, and precise exhaust gas control cannot be performed. Moreover, a further problem occurs that it is difficult to precisely control the exhaust gas. Above all, this tendency becomes remarkable as the fluctuations of the excess air ratio ($\lambda$) between cylinders are large or as the diameter (the sectional area) of the honeycomb structure is large.

To solve these various problems, JP-A-2003-225576 is suggested as follows.

In JP-A-2003-225576, the main surface of partition walls of a honeycomb-like fired article is cut in an oblique cut proceeding direction to provide at least one of a groove, a hole and an edge in the honeycomb-like fired article, whereby the sensor space is secured and the decrease of the catalyst capacity is minimized to obtain a desired purification performance. In this honeycomb of JP-A-2003-225576, when the sensor space having a desired shape is provided, an attempt to adequately control the inflow of the exhaust gas into the sensor is eventually recognized. In this respect, this constitution is appreciated to a certain degree. However, since any gas cannot be sampled from the portions other than the hole for the sensor and the exhaust gas flowing into the sensor stays in a part, the engine cannot be controlled with the excess air ratio ($\lambda$)=1, and it is difficult to precisely control the exhaust gas in a case where the excess air ratio ($\lambda$) noticeably fluctuates between the cylinders. Therefore, it cannot be considered yet that the constitution is sufficient.

Thus, at present, there is not any sufficient countermeasure for the above-mentioned problems, and a further improvement is demanded.

SUMMARY OF THE INVENTION

The present invention has been developed to solve the above problems and aims to provide a honeycomb structure provided with a sensor plug-in hole into which a sensor can be plugged and further provided with a deep hole communicating with the sensor plug-in hole, whereby a gas can be sampled from a portion other than the hole for the sensor. Moreover, the gas flowing from an engine is not only partially but also uniformly allowed to flow into the sensor. In consequence, the engine is easily controlled with an excess air ratio ($\lambda$)=1, and the exhaust gas is precisely controlled. Above all, the precise exhaust gas control can be performed without being influenced by the fluctuations of an excess air ratio ($\lambda$) between cylinders or the size of the diameter (the sectional area) of the honeycomb structure.

According to the present invention, there is provided a honeycomb structure provided with a sensor insertion hole as follows.

[1] A honeycomb structure which is formed by a plurality of cells separated from one another by porous partition walls and functioning as fluid flow paths, the honeycomb structure comprising: a sensor plug-in hole which is formed in the outer peripheral surface of the honeycomb structure and into which a sensor can be plugged, the sensor plug-in hole being provided with at least one deep hole which communicates with the sensor plug-in hole.

[2] The honeycomb structure according to [1], further comprising: at least one lateral hole crossing the at least one deep hole.

[3] The honeycomb structure according to [2], wherein the diameter of each of the deep hole and the lateral hole is twice or more as large as a cell pitch and is 60% or less of the average diameter of the sensor plug-in hole.

[4] The honeycomb structure according to [2] or [3], wherein the deep hole is provided to cross the lateral hole at right angles.

[5] The honeycomb structure according to any one of [2] to [4], wherein the other end of the deep hole that does not communicate with the sensor plug-in hole and at least one end of the lateral hole are closed in the vicinity of an outer peripheral wall of the honeycomb structure.

[6] The honeycomb structure according to any one of [1] to [5], which is made of a ceramic material.

[7] The honeycomb structure according to [6], wherein the ceramic material is at least one selected from the group consisting of cordierite, silicon carbide, alumina, mullite, aluminum titanate and silicon nitride.

[8] The honeycomb structure according to any one of [1] to [5], which is made of a metal foil or a sintered metal.

According to the present invention, the honeycomb structure is provided with the sensor plug-in hole into which the sensor can be plugged and further provided with the deep hole which communicates with the sensor plug-in hole. In consequence, the gas can be sampled from the portion other than the hole for the sensor, and the gas flowing from the engine is not only partially but also uniformly allowed to flow into the sensor. This produces an excellent effect that the honeycomb structure can be provided which easily controls the engine with the excess air ratio (λ)=1 and which precisely controls the exhaust gas. Above all, there can be provided the honeycomb structure capable of precisely controlling the exhaust gas without being influenced by the fluctuations of the excess air ratio (λ) between cylinders or the size of the diameter (the sectional area) of the honeycomb structure.

Furthermore, the precision of the exhaust gas control can similarly be improved even in an engine system which controls the exhaust gas with an excess air ratio other than λ=1 by use of a UEGO sensor, for example, in a lean burn engine or a diesel engine. In addition, the gas is mixed even in a deep hole portion in addition to the holes for the sensor, thereby causing changes in the flow of the exhaust gas. Therefore, a purification performance improves. In addition, each hole has a small diameter, and hence an isostatic strength or the like is not lowered. Moreover, the hole is not a through hole, and hence the deterioration of a grasping portion can be inhibited.

DESCRIPTION OF REFERENCE NUMERALS

Figure 1A:
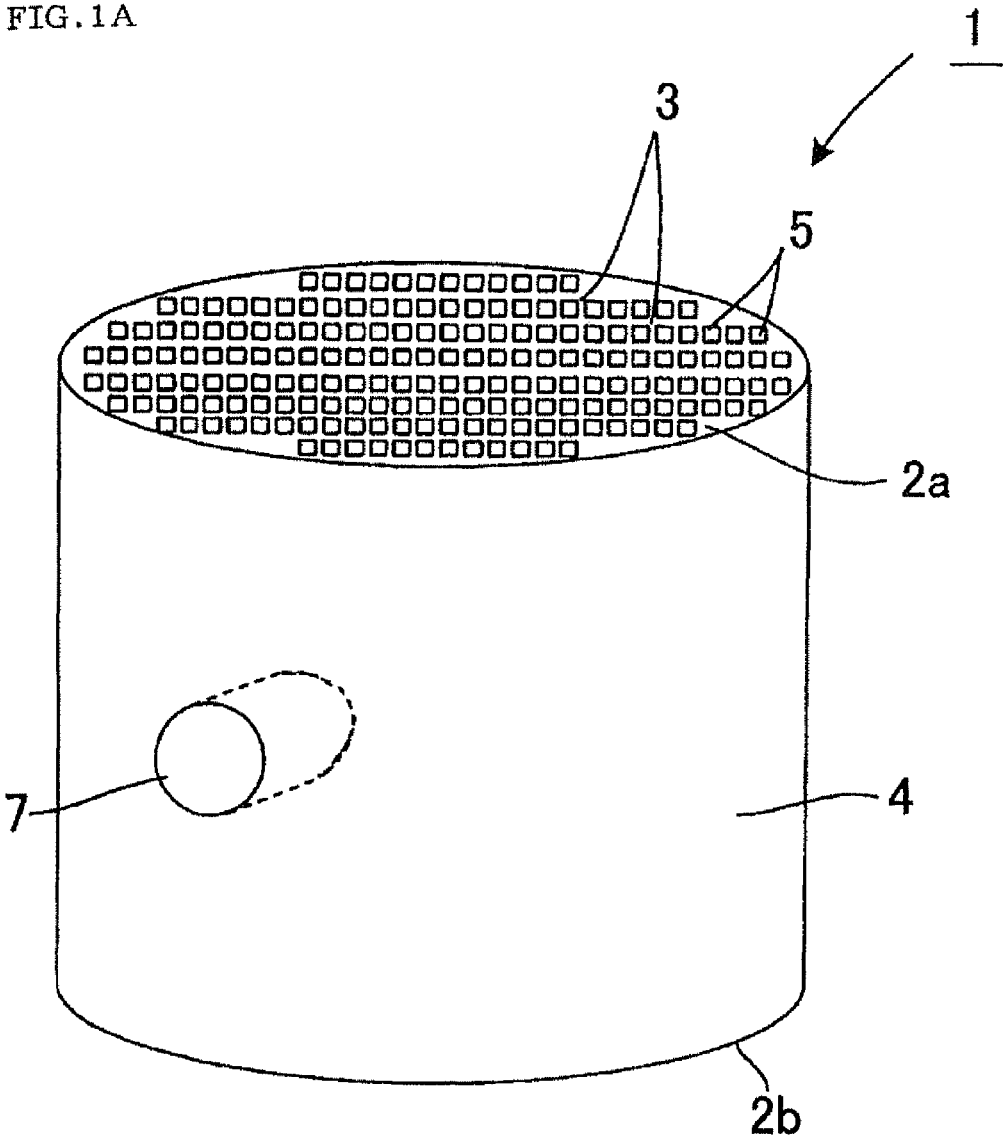
FIG. 1A is a schematic diagram showing a honeycomb structure provided with a sensor insertion hole to which one embodiment of the present invention is applied, and is a perspective view of the honeycomb structure.

1, 1A, 1C, 1D, 1E and 1F: honeycomb structure, 2*a*, 2*b*: end face, 3: partition wall, 4: outer peripheral surface (outer peripheral wall side surface), 5: cell, 7, 7*a*, 7*b*, 7*c* and 7*d*: sensor plug-in hole, 8, 8*a*, 8*b* and 8*c*: deep hole, 8*z*': the other end (of the deep hole), 9: rubber stopper, 10, 10*m*, 10*n* and 10*p*: lateral hole, 10*z*': one end (of the lateral hole), 11: (sensor plug-in hole) opening, 17: the other end of the sensor plug-in hole, 20: engine, 23: oxygen sensor for engine control, 25: air-fuel ratio sensor, 26: air-fuel ratio indicator, 30: honeycomb catalyst, 35: plug, 50: computer for engine control, 60: fuel injection amount control section, A: measurement region, B: measurement region, X-X', $X_1$-$X_1$', $X_2$-$X_2$', $X_3$-$X_3$' and $X_4$-$X_4$': sensor plug-in hole central axis, Y-Y': virtual line, C-C': lateral hole central axis, D-D': lateral hole central axis, and α, α1, α2 and α3: crossing angle.

DETAILED DESCRIPTION OF THE INVENTION

Hereinafter, the best mode for carrying out a firing method of a formed honeycomb article of the present invention will specifically be described. However, the present invention broadly includes a honeycomb structure provided with a sensor insertion hole including specific matters of the invention and is not limited to the following embodiments.

[1] Honeycomb Structure of the Present Invention:

As shown in FIGS. 1A, 2A, 2B and 3, a honeycomb structure 1 of the present invention is the honeycomb structure 1 formed by a plurality of cells 5 separated from one another by partition walls 3 and constituting flow paths of a fluid. An outer peripheral surface 4 of the honeycomb structure 1 is provided with a sensor plug-in hole 7 into which a sensor can be plugged, and the sensor plug-in hole 7 (7*a*) is provided to communicate with at least one deep hole 8.

Here, the honeycomb structure of the present embodiment preferably has a straight-post-like shape with a circular or an elliptic shape of a section vertical to a central axis. That is, as the outer shape of the structure, a shape constituted of two circular or elliptic end faces and an outer peripheral surface (an outer peripheral wall side surface) connecting the end faces to each other is preferably used. In other words, the structure having a cylindrical shape or an elliptic cylindrical shape is preferably used. In such a honeycomb structure, a line connecting the centers of two circular or elliptic end faces to each other is the central axis. However, the embodiment is not limited to such a shape and broadly includes a case where the honeycomb structure has an elliptic shape or another irregular shape, a case where pipes are asymmetrically disposed and the like.

[1-1] Sensor Plug-In Hole:

A plug-in hole provided in the present embodiment is formed in the above-mentioned honeycomb structure and is formed as a hole (a space) formed from the outer peripheral surface (the outer peripheral wall side surface) of this honeycomb structure toward the central axis (the basic axis of the honeycomb structure (the axis in a length direction)). That is, the plug-in hole for the sensor is a hole into which the sensor or the like is plugged (inserted) and is hence referred to as the sensor plug-in hole.

By forming such a sensor plug-in hole in the honeycomb structure in advance, the honeycomb structure is not damaged during the detaching/attaching of the sensor. In addition, after canning, a space for installing the sensor does not have to be intentionally provided. Furthermore, during the attaching/detaching of the sensor, the sensor to be attached comes in contact with honeycomb partition walls and is easily damaged.

Moreover, the sensor plug-in hole is formed so as to communicate with at least one deep hole. When only the sensor plug-in hole is provided, only a part of the gas flows from an engine into the sensor. Therefore, measurement data detected in such a state is not sufficient for exhaust gas control. That is, when the sensor plug-in hole is formed to communicate with at least one deep hole, a fluid (the exhaust gas) is allowed to sufficiently flow into the sensor. In consequence, the more homogeneous gas can be applied to the sensor to detect the sufficient measurement data, and precise exhaust gas control can be realized.

Figure 2A:
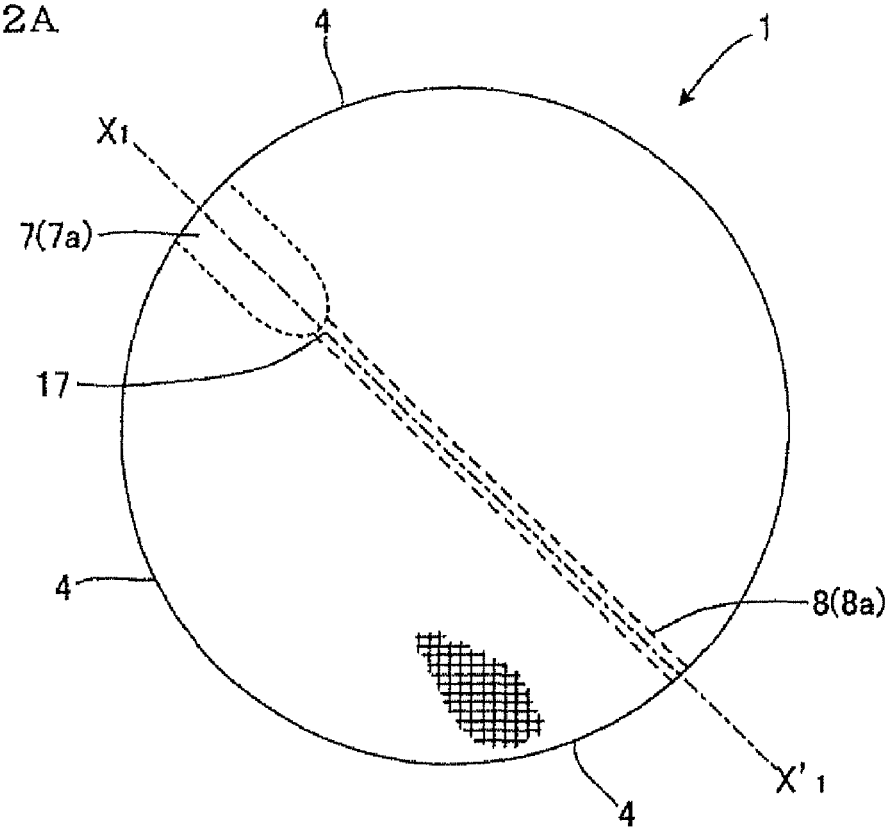
FIG. 2A is a schematic diagram as a plan view showing the honeycomb structure provided with the sensor insertion hole shown in FIG. 1A.
Figure 2B:
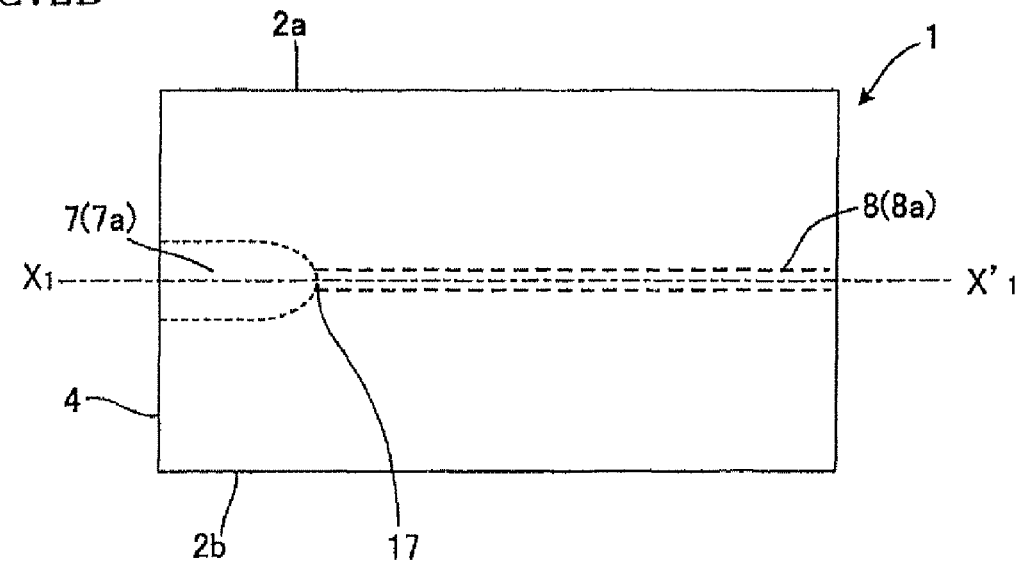
FIG. 2B is a schematic diagram showing the honeycomb structure provided with the sensor insertion hole shown in FIG. 2A, and is a sectional view cut along the center axis $X_1$-$X_1$' of a sensor plug-in hole 7*a*.
Figure 3:
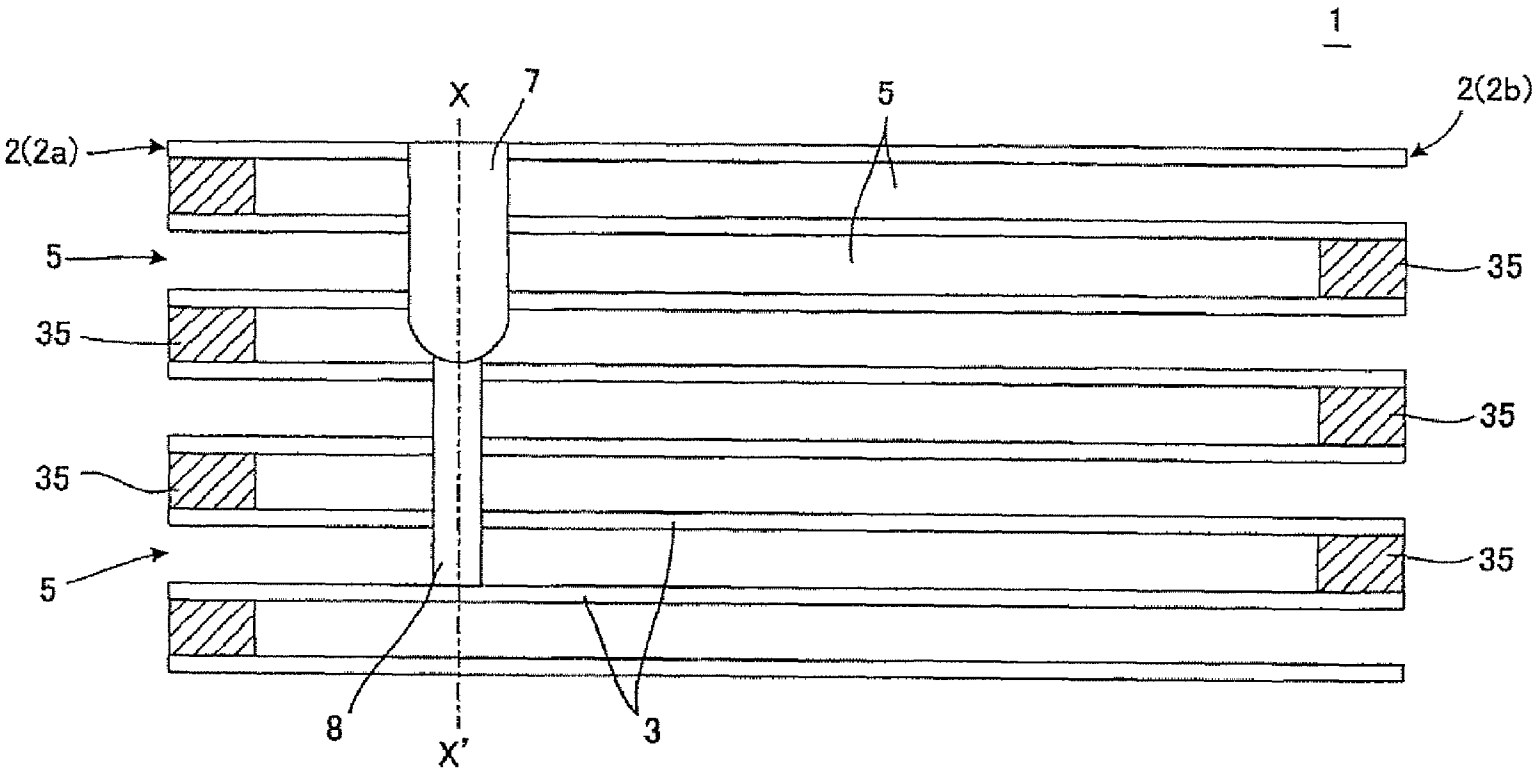
FIG. 3 is a schematic diagram showing a honeycomb structure provided with a sensor insertion hole to which one embodiment of the present invention is applied, and is a sectional view cut along the length direction (an exhaust gas inflow/outflow direction) of the honeycomb structure.
Figure 4:
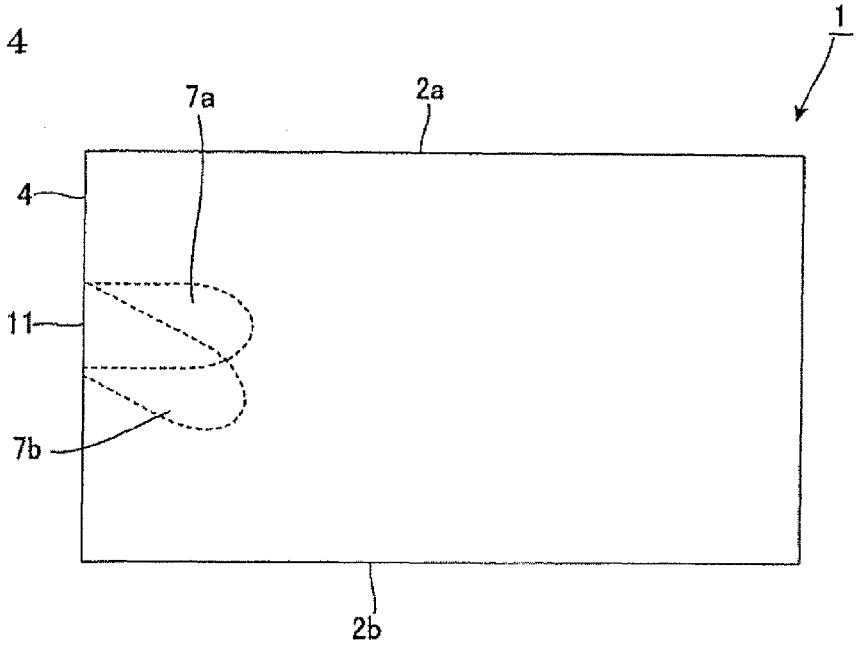
FIG. 4 is a schematic diagram showing another embodiment of the present invention, and is a sectional view cut along a honeycomb length direction, showing one variation of a sensor plug-in hole.

Specifically, the sensor plug-in hole is shown in FIGS. 2A, 2B.

Moreover, a sensor plug-in hole forming direction may or does not have to extend from the outer peripheral surface (the outer peripheral wall side surface) of the honeycomb structure toward the central axis thereof. Moreover, the sensor plug-in hole forming direction may or does not have to be parallel to two end faces. In other words, (1) as shown in FIGS. 1A, 2A, 2B and 4, the sensor plug-in hole may be formed in parallel with end faces 2*a*, 2*b* of the honeycomb structure from the outer peripheral surface (the outer peripheral wall side surface) of the honeycomb structure having an opening 11 of the sensor plug-in hole to a honeycomb central axis direction (e.g., the sensor plug-in hole 7*a*); (2) the sensor plug-in hole may be formed from the outer peripheral surface (the outer peripheral wall side surface) of the honeycomb structure having the opening 11 of the sensor plug-in hole to the outer peripheral surface (the outer peripheral wall side surface) of the honeycomb structure while tilting toward the end faces 2*a*, 2*b* of the honeycomb structure; and (3) the sensor plug-in hole opened in the outer peripheral surface (the outer peripheral wall side surface) may be directed downwards (in a direction toward the one end face) when the honeycomb structure is raised with one end face thereof being the bottom surface thereof (e.g., a sensor plug-in hole 7*b*).

It is to be noted that in a case where the honeycomb structure has an irregular shape such as an elliptic shape or pipes are asymmetrically disposed, a position where temperature most easily rises owing to the influence of a gas flow is measured in advance, and the sensor hole is preferably provided in the position.

Examples of the shape of the plug-in hole include a round shape, an elliptic shape and a triangular shape, but the shape of the plug-in hole is not limited to these shapes, and a preferable shape may be selected in accordance with the shape of a desired sensor to be attached. However, from the viewpoints of response and durability and for the sake of convenience during the forming, the round shape is more preferable.

As a method for forming the sensor plug-in hole, the sensor plug-in hole is preferably formed in a formed honeycomb article (the so-called raw honeycomb) before firing or the honeycomb structure obtained after the firing by use of a drilling tool such as a drill.

As the dimensions of the sensor plug-in hole, the hole preferably has such a size that various sensors can be inserted into the hole. For example, a usual sensor has a dimension of about 0.1 to 20 mmϕ, but the dimension is not limited to this example, and the hole dimension is preferably appropriately selected, as necessary, so that the sensor having a preferable dimension can be used as required. For example, in the case of a thermocouple for measuring temperature, a sheath type thermocouple is used, and examples of a commercially available size of the thermocouple usually include ϕ0.5, ϕ1.0, ϕ1.6, ϕ2.3, ϕ3.2, ϕ4.8, ϕ6.4 and ϕ8.0 mm. Moreover, in addition to the examples having the above sizes, the other examples of the thermocouple for measuring temperature include so-called very fine type thermocouples having sizes of ϕ0.15 mm and ϕ0.25 mm. Such a very fine type can be measured for the measurement of a relatively low temperature portion from which any durability is not demanded. Moreover, a gas sensor such as an oxygen sensor usually has a dimension of 10 to 15 mmϕ.

Figure 1B:
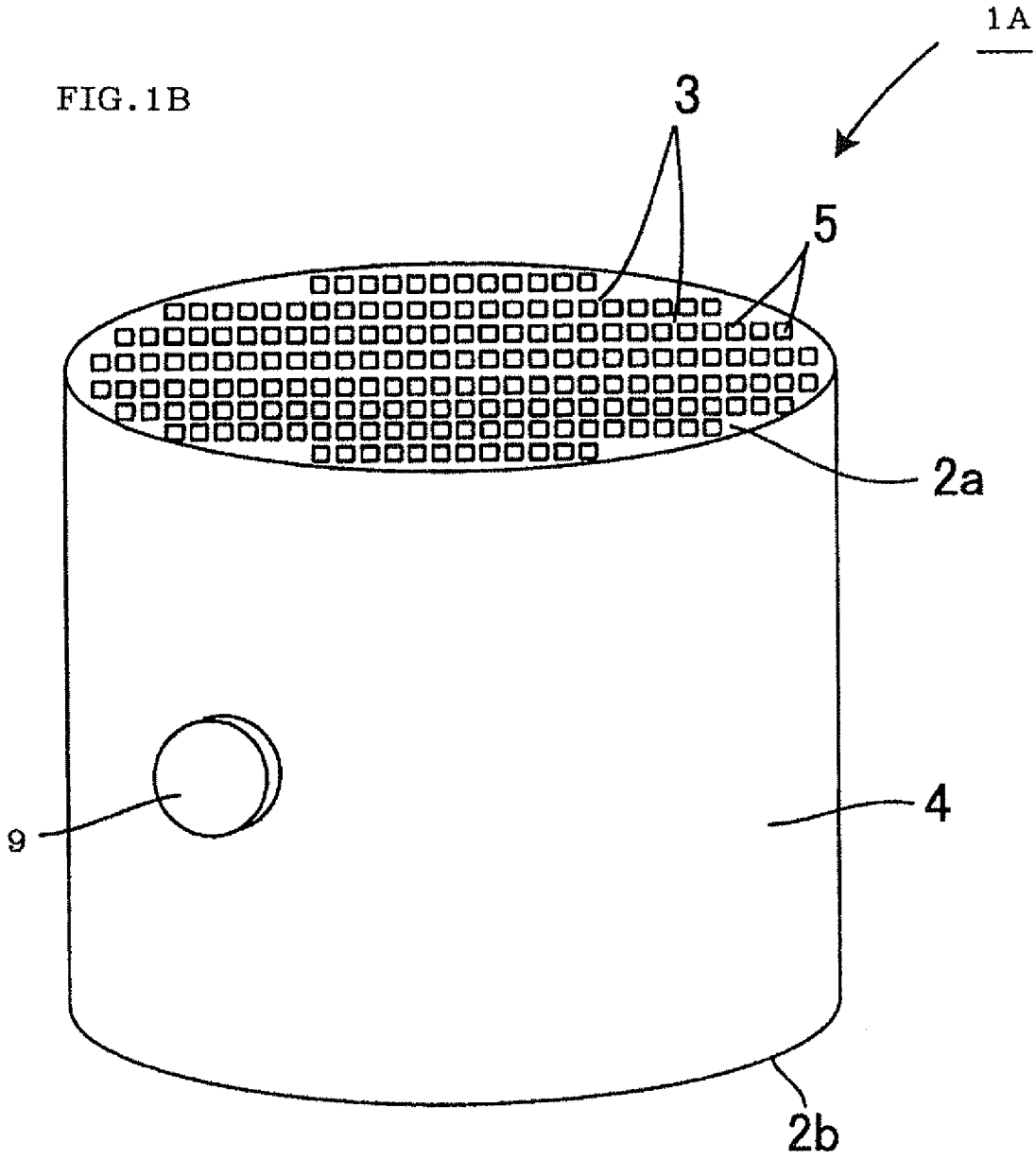
FIG. 1B schematically shows a state that a rubber stopper is attached to the honeycomb structure of FIG. 1A.

Furthermore, when an isostatic strength is evaluated as described later, as shown in FIG. 1B, a rubber stopper 9 is used in the sensor plug-in hole, and a sensor is attached into the hole. In this case, the sensor is inhibited from coming out of the honeycomb structure and is stabilized in the honeycomb structure. Moreover, the lowering of the strength of the honeycomb structure provided with the hole for inserting the sensor is inhibited, and an edge portion of the hole can preferably be inhibited from being chipped. When, for example, a rubber stopper having (1) a hardness of 45 or more and 90 or less, (2) a clearance of 0.2 mm or more and 2.6 mm or less between the stopper and the inner surface of the insertion hole in parallel to the depth direction of an insertion hole during insertion and (3) a protruding height of 0.5 mm or more and 5 mm or less from the outer surface of the honeycomb structure during the insertion is inserted into the insertion hole of the honeycomb structure provided with the sensor plug-in hole, and thereby the inhibition of the coming-off and the stability can be secured.

It is to be noted that, after attaching the sensor to the sensor plug-in hole, a part of the sensor may be provided with a screw structure or a hook portion such as a concave/convex portion to inhibit the coming-off of the sensor and stabilize the sensor. When the sensor has, for example, a screw-like shape, an M4 or M5 size may be used. Thus, the thermocouples have various sizes and variations, but, in respect of the diameter of the thermocouple, the larger diameter usually advantageously provides the durability, and the smaller diameter provides an excellent response. Moreover, in a gas sensor such as the oxygen sensor, an M16 or M18 size is frequently used.

However, if the dimensions of the plug-in hole are equal to that of the sensor to be inserted, when the sensor is inserted into the plug-in hole, both the honeycomb and the sensor are unfavorably damaged. Therefore, the diameter of the hole is preferably about ϕ0.2 to ϕ25 mm from the viewpoints of the response and the durability. The hole preferably has a depth of about 10 to 25 mm from a honeycomb outer peripheral surface (the outer peripheral wall side surface) because the homogeneous gas is easily applied to (is easily allowed to flow into) the measurement point of the sensor, when the sensor is attached to the hole.

[1-2] Deep Hole:

In the present embodiment, at least one deep hole is formed to communicate with the sensor plug-in hole. As described above, when only the sensor plug-in hole is provided, only a part of the gas flows into the sensor, and exhaust gas control based on detected measurement data is insufficient. Furthermore, when the temperature, oxygen concentration, NOx concentration or the like of the exhaust gas is measured using the sensor, only a part of a fluid is usually applied to the sensor. Therefore, various conditions such as the inflow amount, direction and flow rate of the fluid vary depending on the position of the sensor installed in the honeycomb, and the measurement results easily fluctuate. When such a fluctuation is generated, the state of the exhaust gas cannot adequately be measured. Above all, as the diameter (the sectional area) of the honeycomb structure is large, the temperature, the oxygen concentration, the NOx concentration and the like locally remarkably fluctuate, and the measurement results also easily fluctuate.

However, in the present embodiment, when at least one deep hole is formed to communicate with the sensor plug-in hole, the gas flowing from the engine can be applied to (allowed to flow into) the sensor more homogeneously. Therefore, the engine can easily be controlled with an excess air ratio ($\lambda$)=1, the exhaust gas flowing into the honeycomb can exactly be controlled, measured and detected, and precise exhaust gas control is achieved. Above all, the precise exhaust gas control can be achieved without being influenced by the fluctuations of $\lambda$ between cylinders, or the size of the diameter (the sectional area) of the honeycomb structure. That is, when any deep hole portion is not formed, the exhaust gas is simply mixed only in the sensor hole. However, in a case where the deep hole portion is formed, the exhaust gas is mixed not only in the sensor hole but also in the deep hole portion, changes are generated in the flow of the exhaust gas which has merely flowed in or out in a fixed direction, the homogeneous gas can be applied to the sensor, and the state of the exhaust gas can precisely be measured. Therefore, a purification performance can remarkably be improved.

Here, the deep hole "communicates with" the sensor plug-in hole means that, in one end and the other end of the deep hole, the deep hole is opened with respect to the end of the deep hole opposite to the sensor plug-in hole in the length direction of the sensor plug-in hole (hereinafter appropriately referred to as "the other end of the sensor plug-in hole"). There is not any special restriction on the opening portion (the communication portion) of the deep hole with respect to the sensor plug-in hole. The communication portion may be formed, for example, in the middle of the sensor plug-in hole in the length direction or formed to communicate with the other end of the sensor plug-in hole. However, from the viewpoint that the exhaust gas be sufficiently applied to the measurement point of the sensor to perform precise measurement, the deep hole is preferably formed to communicate with the other end of the sensor plug-in hole.

In a specific example, as shown in FIGS. 2A, 2B, the deep hole 8 is formed to open with respect to a sensor plug-in hole other end 17 in the length direction of the sensor plug-in hole 7*a*.

Furthermore, more preferable examples of the deep hole which "communicates with" the sensor plug-in hole include (1) a deep hole having the central axis thereof which agrees with the extended central axis of the sensor plug-in hole and (2) a deep hole formed so that the central axis thereof has a fixed angle with respect to that of the sensor plug-in hole. When the deep hole (1) is formed, the mixed exhaust gas can sufficiently be applied to the measurement point of the sensor. When the deep hole (2) is formed, the mixed exhaust gas can sufficiently be applied to the measurement point of the sensor, and the deep hole can arbitrarily be formed in accordance with the desired dimension or the desired shape of the honeycomb structure. Above all, in the case of (2), the strength respect (e.g., the isostatic strength or the like) of the honeycomb structure can finely be regulated.

Figure 5A:
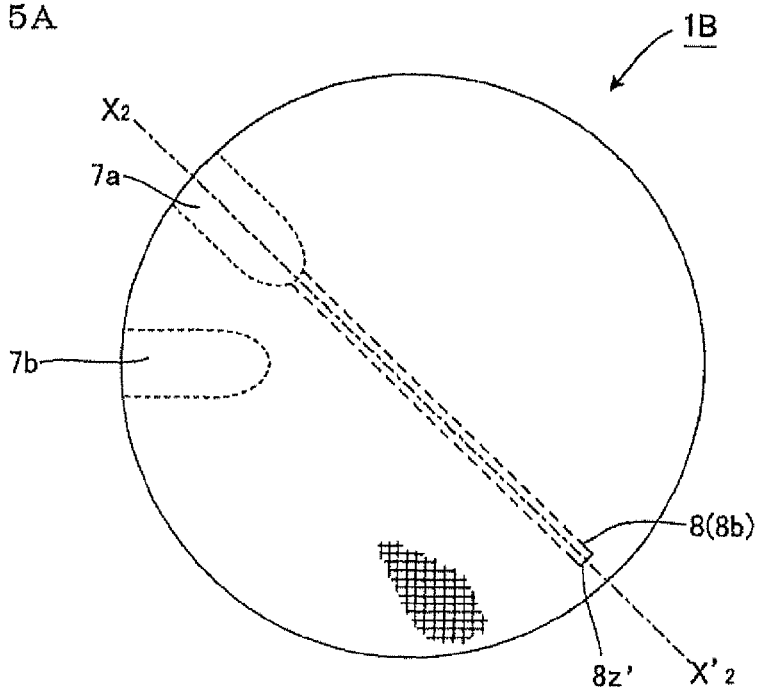
FIG. 5A is a front view showing still another embodiment of the present invention and is a diagram schematically showing one example of a communication state between the sensor plug-in hole and a deep hole.
Figure 5B:
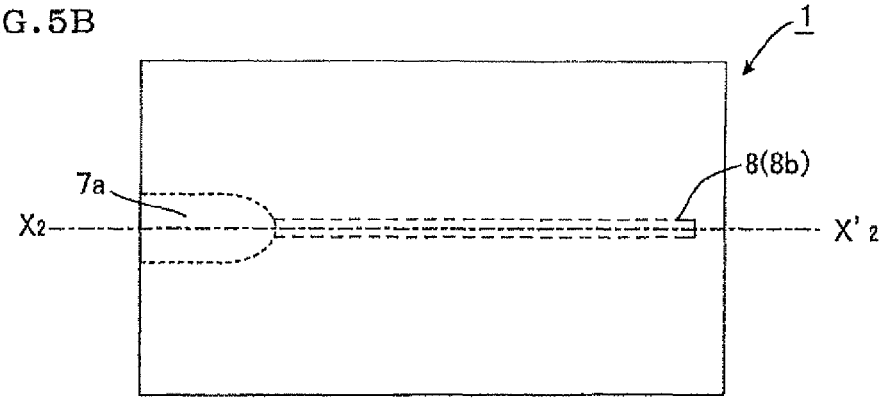
FIG. 5B is a diagram schematically showing a honeycomb of FIG. 5A cut along the length direction thereof.
Figure 6:
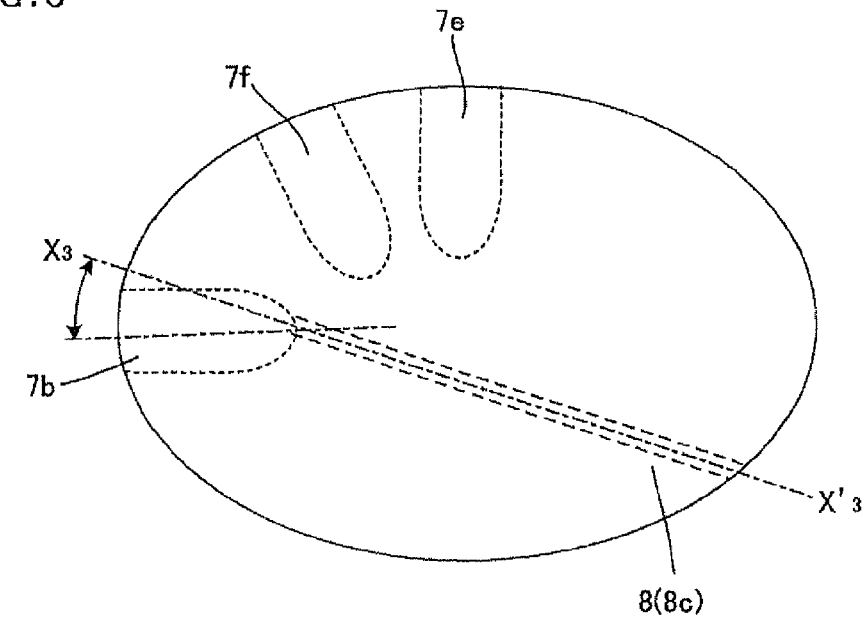
FIG. 6 is a front view showing still another embodiment of the present invention and schematically showing one example of a communication state between a sensor plug-in hole and a deep hole.

Examples of the deep hole (1) having the central axis thereof which agrees with the extended central axis of the sensor plug-in hole include a deep hole 8*a* formed in the extended direction of a central axis $X_1$-$X_1$' of the sensor plug-in hole 7*a* as shown in FIGS. 2A, 2B and a deep hole 8*b* formed in the extended direction of a central axis $X_2$-$X_2$' of the sensor plug-in hole 7*a* as shown in FIGS. 5A, 5B. Examples of the deep hole (2) formed so that the central axis thereof has the fixed angle with respect to that of the sensor plug-in hole include a deep hole 8*c* formed to tilt with respect to a $X_3$-$X_3$' of the sensor plug-in hole 7*a* as shown in FIG. 6.

Thus, there is not any special restriction on a position (the direction) where the deep hole is formed as long as the deep hole communicates with the sensor plug-in hole, and various variations of the deep hole can be adopted.

It is to be noted that "the fixed angle" in the above deep hole (2) indicates that the angle of the central axis of the deep hole crossing the central axis of the sensor plug-in hole is preferably in a range of 5 to 50°, depending on the inflow situation of the exhaust gas.

Moreover, "the isostatic strength" is represented by a pressurizing pressure value at a time when a carrier breaks down and is defined by JASO standard M505-87 as the automotive standard issued by Society of Automotive Engineers of Japan. An isostatic breakdown strength test for measuring this isostatic strength is a test in which a carrier is put in a rubber cylindrical container, and the container is closed with an aluminum plate lid to perform isostatic pressurizing compression in water. It is usual to perform simulation of an applied compressive load in a case where the outer peripheral surface (the outer peripheral wall side surface) of the carrier is grasped by a converter can member.

It is to be noted that, in the present embodiment, "at least one deep hole is formed to communicate with the sensor plug-in hole". In consequence, a case where a plurality of sensor plug-in holes are formed, a case where a plurality of deep holes are formed, a case where a plurality of sensor plug-in holes and deep holes are formed and the like are broadly included in the present embodiment as long as at least one deep hole is provided to communicate with the sensor plug-in hole. In other words, the other sensor plug-in holes and deep holes are not limited to the above examples and may be formed so that the holes communicate or do not communicate with each other.

Moreover, examples of the shape of the deep hole include a round shape, an elliptic shape and a triangular shape, but the deep hole is not limited to these shapes, and a preferable shape may be selected in accordance with the shape of the desired sensor to be attached. However, from the viewpoints of the response and the durability, for the ease of a forming step and the like, the round shape is more preferable, and a shape analogous to the plug-in hole is further preferable.

Furthermore, as the dimension of the deep hole, from the viewpoints of the response and the durability, the hole preferably has a diameter of about ϕ0.2 to ϕ15 mm. Moreover, the hole preferably has a depth (the length) in a range of about 2 to 10 mm from the honeycomb outer peripheral surface (the outer peripheral wall side surface) opposite to the sensor plug-in hole. When the deep hole is formed, the dimension of the deep hole or the depth (the length) of the deep hole is set to a desired dimension, whereby changes can be imparted to the inflow, outflow or the like of the exhaust gas, and a state in which the gas is easily mixed can be produced. In consequence, the homogeneous gas is preferably easily allowed to flow into the sensor plug-in hole.

Moreover, "at least one" deep hole communicates with the sensor plug-in hole means that one or a plurality of deep holes may be formed. In a case where, for example, only one deep hole is formed, the deep hole may be formed to surely communicate with the sensor plug-in hole. In a case where the plurality of deep holes are formed, one or more of them may be formed to communicate with the sensor plug-in hole. In other words, in a case where the plurality of deep holes, for example, two deep holes are formed, the deep holes may be formed so that only one of them communicates with the sensor plug-in hole, whereas the remaining deep hole does not communicate with the sensor plug-in hole. Alternatively, both the two deep holes may be formed to communicate with the sensor plug-in hole. Moreover, in a case where three deep holes are formed, the deep holes may be formed so that only one of them communicates with the sensor plug-in hole, whereas the remaining two deep holes do not communicate with the sensor plug-in hole. Alternatively, the deep holes may be formed so that only two deep holes communicate with the sensor plug-in hole, whereas the remaining deep hole does not communicate with the sensor plug-in hole. Alternatively, all of the three deep holes may be formed to communicate with the sensor plug-in hole. This also applies to a case where more deep holes are formed.

When the deep hole is extended through a honeycomb end face, the gas can be sampled even from a portion other than the sensor hole. In consequence, the exhaust gas can more precisely be controlled, and the precision of the exhaust gas control can preferably similarly be improved even in an engine system which controls the exhaust gas with an excess air ratio other than the excess air ratio (λ)=1 by use of a UEGO sensor, for example, a lean burn engine and a diesel engine. In a case where the deep hole is formed so that the deep hole does not extend through the honeycomb outer peripheral surface, the deep hole may be formed from the side of the sensor hole.

It is to be noted that the above "universal exhaust gas oxygen (UEGO) sensor" is a sensor capable of detecting the concentration of oxygen in the engine exhaust gas to recognize the air-fuel ratio of a mixed gas over a wide range from a lean region to a rich region.

Moreover, the deep hole may extend through the honeycomb end face or may be formed in such a manner that it does not extend through the honeycomb end face.

Figure 7:
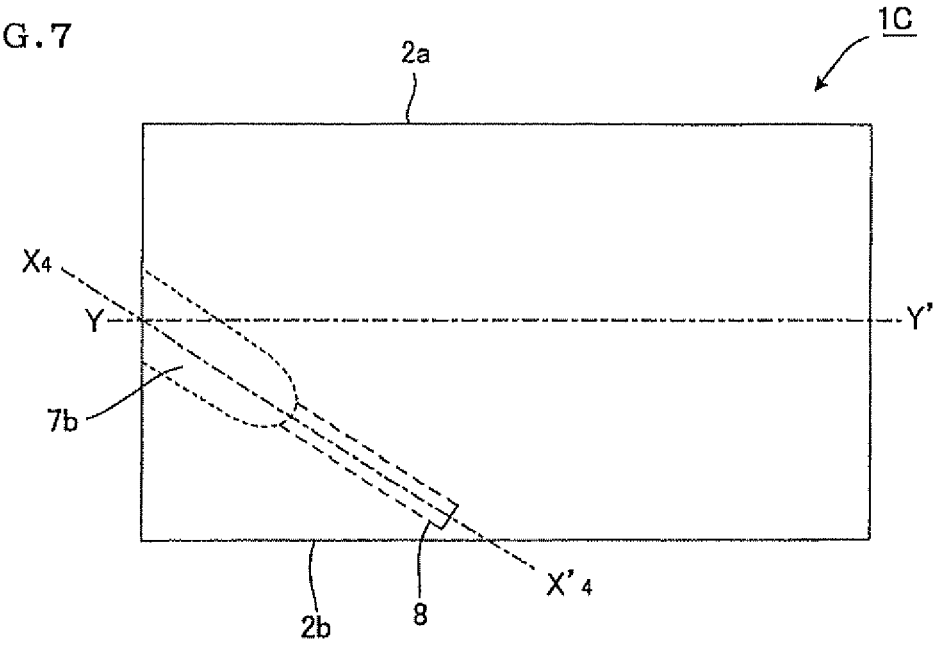
FIG. 7 is a front view showing still another embodiment of the present invention and schematically showing one example of a communication state between a sensor plug-in hole and a deep hole.

Specifically, the deep hole may extend through the honeycomb outer peripheral surface as in the deep hole 8*a* shown in FIGS. 2A, 2B, or the deep hole may be formed in such a manner that it does not extend through the honeycomb outer peripheral surface to be closed in the vicinity of the outer peripheral wall as in the deep hole 8*b* shown in FIGS. 5A, 5B. Moreover, the deep hole may be formed to extend through the honeycomb outer peripheral surface and then closed with the same material as a honeycomb material to form the deep hole 8*b* as shown in FIGS. 5A, 5B. Furthermore, as shown in FIG. 7, the deep hole may be formed from the side of the sensor hole so that the deep hole does not extend through the honeycomb end face. It is to be noted that a virtual line Y-Y shown in FIG. 7 is a line parallel to the honeycomb end faces 2*a*, 2*b*. Moreover, as shown in FIG. 5A or 6, the honeycomb structure is sometimes provided with plug-in holes for a plurality of different sensors, for example, a gas sensor such as the oxygen sensor and the thermocouple.

As a method for forming the deep hole, the deep hole is preferably formed in the formed honeycomb article (the so-called raw honeycomb) before firing or the honeycomb structure obtained after the firing by use of a drilling tool such as the drill.

[1-3] Relation Between Deep Hole and Lateral Hole in the Present Embodiment:

Moreover, at least one lateral hole crossing at least one deep hole is preferably provided. When not only the deep hole communicating with the sensor plug-in hole but also a lateral hole crossing the deep hole are provided, changes can further be imparted to the exhaust gas flow obtained by mixing the gas in the deep hole, and the gas can sufficiently be mixed. That is, when the exhaust gas flows into or out of the lateral hole, it is like the honeycomb structure is provided with a new flow path, and the changes of the inflow/outflow of the gas can be imparted to the sensor plug-in hole and the deep hole through the porous partition walls. In consequence, the changes further promote the mixing of the gas in the sensor plug-in hole and the deep hole, and hence the more homogeneous gas is applied to the sensor. Consequently, precise measurement can be achieved, and the finer regulation of gas purification can be realized. Therefore, the purification performance can remarkably be improved.

Furthermore, when such a lateral hole is formed, the exhaust gas control can similarly precisely be realized even in the engine system which controls the exhaust gas with an excess air ratio other than λ=1 by use of the UEGO sensor, for example, the lean burn engine and the diesel engine.

This lateral hole may extend through the honeycomb outer peripheral surface, or may be formed in such a manner that it does not extend through the honeycomb outer peripheral surface to close in the vicinity of the outer peripheral wall. Moreover, the lateral hole may be extended through the honeycomb outer peripheral surface and then closed with the same material as the honeycomb material.

When the lateral hole is extended through the honeycomb outer peripheral surface, the gas can preferably be sampled from a portion other than the sensor hole. When the lateral hole is not extended through the honeycomb outer peripheral surface and is closed in the vicinity of the outer peripheral wall, or when the lateral hole is extended through the honeycomb outer peripheral surface and then closed with the same material as the honeycomb material, the lateral hole is not a so-called through-hole, and hence the deterioration of a grasping material can preferably be prevented.

Here, the lateral hole "crosses the deep hole", it means that the lateral hole and the deep hole are formed in the length direction of the honeycomb structure to communicate with each other. That is, it means that the holes are formed in the same surface of the honeycomb structure in a horizontal direction thereof. However, when a plurality of deep holes are formed, when a plurality of lateral holes are formed, or when a plurality of deep holes and lateral holes are formed, at least one lateral hole crossing at least one deep hole has to be provided. In other words, the other lateral holes are not limited to the above example, and the lateral hole and the deep hole may be formed in the length direction of the honeycomb structure so that they do not communicate or communicate with each other. Alternatively, the holes may be formed in the same surface of the honeycomb structure in the horizontal direction or in a vertical direction.

When, for example, only one lateral hole is formed, the one lateral hole has to cross the deep hole. When the plurality of lateral holes are formed, at least one of them has to surely cross the deep hole. In other words, in a case where the plurality of lateral holes, for example, two lateral holes are formed, the lateral holes are formed so that only one of them crosses the deep hole, whereas the remaining lateral hole does not cross the deep hole, or so that both of them cross the deep hole. Moreover, in a case where three lateral holes are formed, the lateral holes may be formed so that only one of them crosses the deep hole, whereas the remaining two lateral holes do not cross the deep hole. Alternatively, the lateral holes may be formed so that only two of them cross the deep hole, whereas the remaining lateral hole does not cross the deep hole. Alternatively, all of the three lateral holes may be formed to cross the deep hole. This also applies to a case where more lateral holes are formed.

Figure 8A:
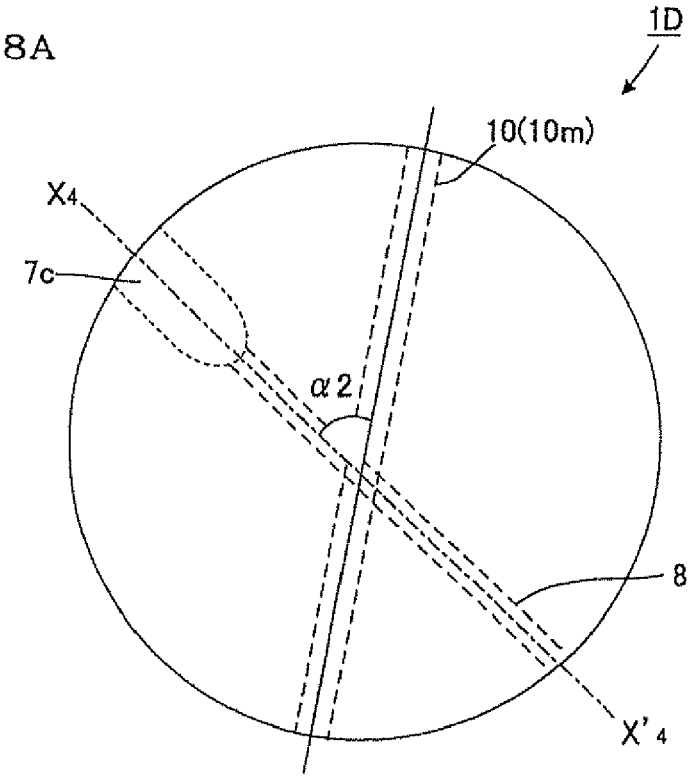
FIG. 8A is a front view showing still another embodiment of the present invention and schematically showing one example of a positional relation between a sensor plug-in hole and a deep hole.
Figure 8B:
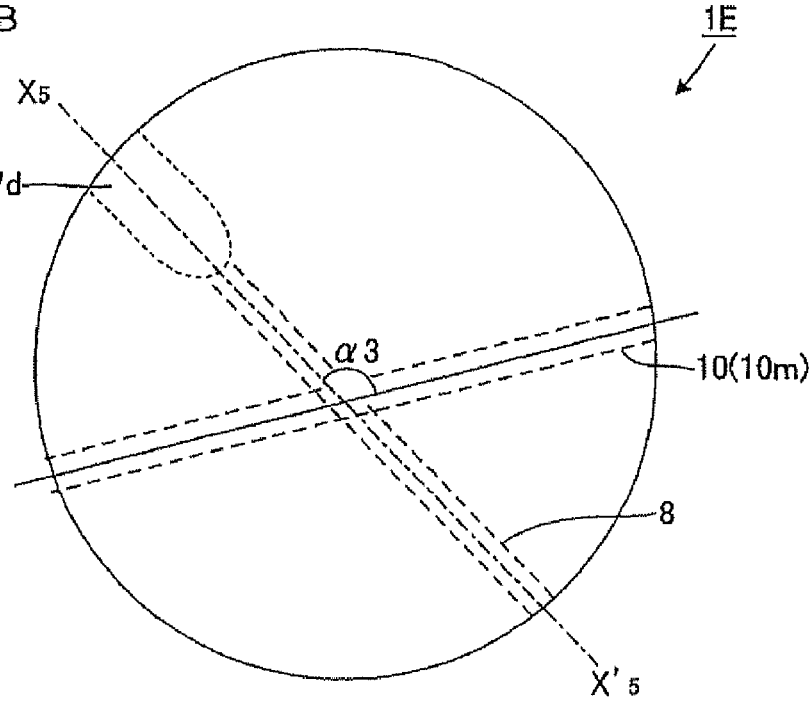
FIG. 8B is a front view showing still another embodiment of the present invention and schematically showing one example of a positional relation among a sensor plug-in hole and a deep hole and a lateral hole.

Specifically, the lateral hole may cross the deep hole so that a crossing angle ($\alpha$) between the central axis of the lateral hole and the central axis of the deep hole is an acute angle as shown in FIG. 8A or so that a crossing angle ($\alpha$2) between the central axis of the lateral hole and the central axis of the deep hole is an obtuse angle as shown in FIG. 8B. When the crossing angle is 90°, the exhaust gas is most easily uniformly be taken into the sensor hole. Moreover, when the angle is 25° or less, the honeycomb structure has an unfavorable strength. An optimum angle may be obtained in accordance with the flow state of the exhaust gas experimentally by a flow analysis using a computer or by use of the engine.

Moreover, examples of the shape of the lateral hole include a round shape, an elliptic shape and a triangular shape, but the shape of the lateral hole is not limited to these shapes, and a preferable shape may be selected in accordance with the shape of the desired sensor to be attached. However, from the viewpoints of the response and the durability, for the ease of the forming step and the like, the round shape is more preferable. Furthermore, the lateral hole preferably has a shape analogous to the sensor plug-in hole and the deep hole.

Furthermore, as to the dimension of the lateral hole, the diameter of the hole is preferably about $\phi$0.2 to $\phi$25 mm from the viewpoints of the response and the durability. The hole preferably has a depth (the length) of about 1 to 10 mm from the honeycomb outer peripheral surface (the outer peripheral wall side surface). When the lateral hole diameter and the lateral hole depth (the length) are set to desired dimensions, the more homogeneous gas is preferably easily allowed to flow into the sensor plug-in hole and the deep hole through the porous partition walls. Moreover, the diameter of the lateral hole is preferably set to a diameter substantially equal to that of the deep hole in respect of gas circulation.

As a method for forming the lateral hole, the lateral hole is preferably formed in the formed honeycomb article (the so-called raw honeycomb) before firing or the honeycomb structure obtained after the firing by use of a drilling tool such as the drill.

[1-4] Relation Among Sensor Plug-In Hole, Deep Hole, and Lateral Hole:

Moreover, the diameter of each of the deep hole and the lateral hole is preferably twice or more a cell pitch and is 60% or less of the average diameter of the sensor plug-in hole. When the diameter of each of the deep hole and the lateral hole is set to a desired dimension, the lowering of the isostatic strength or the like is not caused, and the effect of the present invention can be exhibited. On the other hand, when the diameter of each of the deep hole and the lateral hole is less than twice the cell pitch, the exhaust gas does not sufficiently flow into the sensor hole, and the original effect cannot sufficiently be exhibited. Moreover, when the diameter of each of the deep hole and the lateral hole is larger than 60% of the average diameter of the sensor plug-in hole, the strength characteristics of the honeycomb structure might unfavorably be lost. Therefore, when the diameter of each of the deep hole and the lateral hole is set in a desired numeric range, the diameter of each of the deep hole and the lateral hole decreases, and the lowering of the isostatic strength or the like can preferably be inhibited.

It is to be noted that various methods for defining "the average diameter of the sensor hole" are considered, and examples of the diameter include (1) the diameter of a portion having a depth of ½ of the hole depth and (2) the diameter of an assumed circular section of the hole having the sectional area obtained by (a hole capacity)/(the hole depth). The "average diameter of the sensor hole" is used in the above meaning (2). When the section is circular, the sectional area of the hole of the honeycomb structure is obtained by (the hole capacity)/(the hole depth) to obtain the diameter of the hole. Furthermore, when the honeycomb structure includes the hole having a section other than the circular section, the diameter of the portion of the hole having a depth of ½ of the hole depth is obtained as a hydraulic diameter.

More preferably, the deep hole and the lateral hole are provided to cross each other at right angles. While maintaining the isostatic strength, changes can be imparted to the exhaust gas, and the more homogeneous gas can preferably be allowed to flow into the sensor plug-in hole.

Here, "the deep hole and the lateral hole cross each other at right angles" means that the lateral hole and the deep hole are formed to communicate with each other in the length direction of the honeycomb structure and that the holes cross each other at right angles in the planar view of the honeycomb structure while so-called three-dimensionally crossing each other. That is, it means that the holes are formed in the same surface of the honeycomb structure in the horizontal direction and that the crossing angle is a right angle in the planar view of the honeycomb structure. However, when a plurality of deep holes are formed, when a plurality of lateral holes are formed, or when a plurality of deep holes and lateral holes are formed, the holes are formed so that at least one of the deep holes crosses the lateral hole at right angles. In other words, the other deep holes and the other lateral holes are not limited to the above constitution, and the holes may be formed so that the lateral hole does not communicate with the deep hole in the length direction of the honeycomb structure or so that the holes communicate with each other. Alternatively, the holes may be formed in the same surface in the horizontal direction or a vertical direction of the honeycomb structure. Furthermore, the holes may be formed so that the lateral hole and the deep hole cross or do not cross each other at right angles.

Figure 9A:
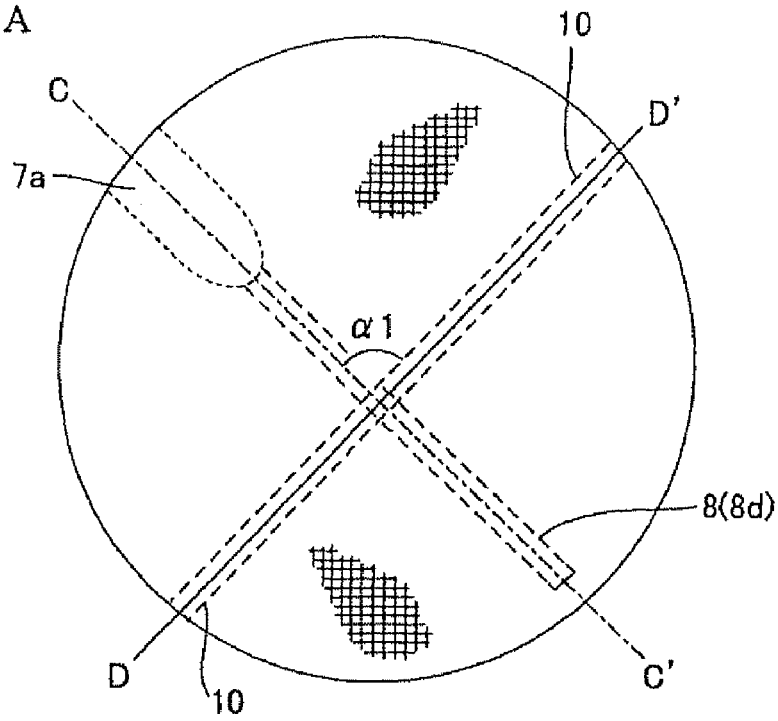
FIG. 9A is a front view showing still another embodiment of the present invention and schematically showing one example of a positional relation among a sensor plug-in hole and a deep hole and a lateral hole.

As a specific example, the holes cross each other so that a crossing angle ($\alpha$1) between the central axis (the D-D' line) of the lateral hole and the central axis (the C-C' line) of the deep hole is a right angle as shown in FIG. 9A.

Furthermore, the other end of the deep hole that does not communicate with the sensor plug-in hole and at least one end of the lateral hole are preferably closed in the vicinity of the outer peripheral wall of the honeycomb structure. Thus, the other end of the deep hole that does not communicate with the sensor plug-in hole and at least one end of the lateral hole (the other end of the deep hole opposite to the other end of the sensor plug-in hole, appropriately hereinafter referred to as "the other end of the deep hole") are closed in the vicinity of the outer peripheral wall of the honeycomb structure, and additionally at least one end of the lateral hole is closed in the vicinity of the outer peripheral wall of the honeycomb structure. In consequence, the lowering of the isostatic strength or the like is not caused. The holes are not through-holes, and hence the deterioration of the grasping portion can be inhibited. The effect of the present invention can preferably be exhibited.

Figure 8C:
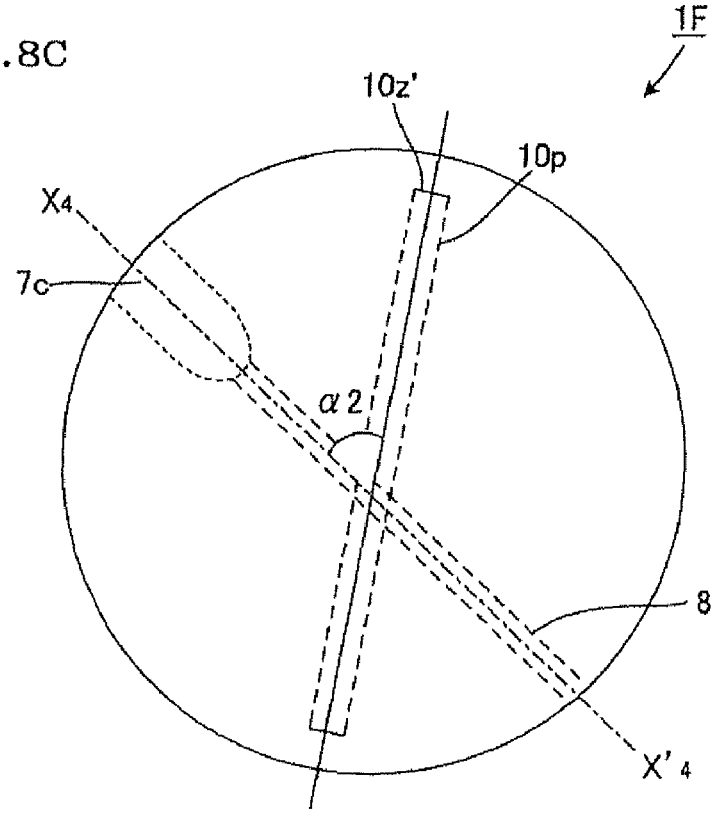
FIG. 8C is a front view showing still another embodiment of the present invention and schematically showing one example of a positional relation among a sensor plug-in hole and a deep hole and a lateral hole.
Figure 9B:
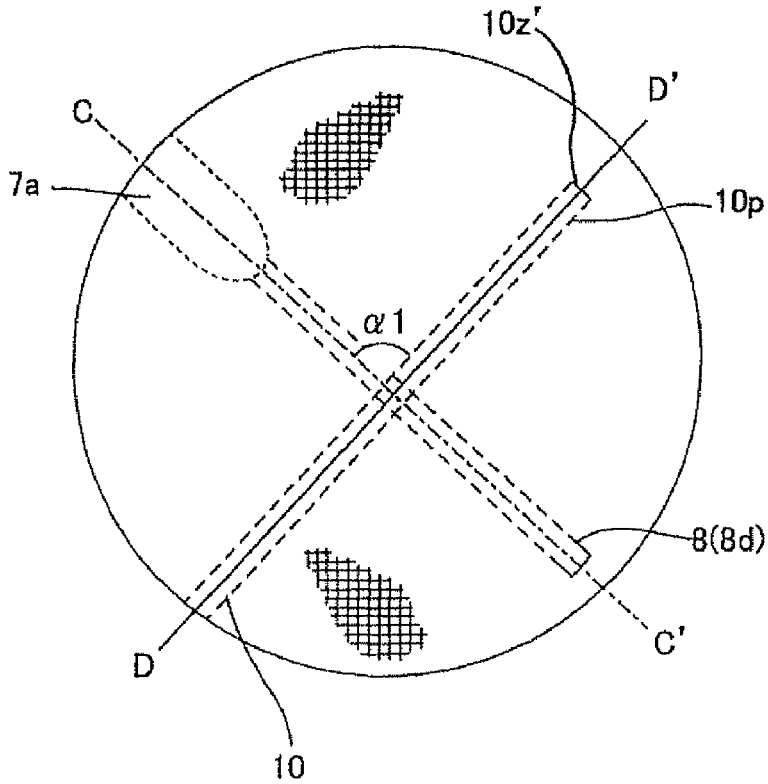
FIG. 9B is a front view showing yet another embodiment of the present invention and schematically showing one example of a positional relation among a sensor plug-in hole and a deep hole and a lateral hole.

Specific examples of the ends include the other end 8*z*' of the deep hole 8*b* that does not communicate with the sensor plug-in hole as shown in FIG. 5A and one end 10*z*' of the lateral hole shown in FIGS. 8C, 9B.

To close the deep hole and the lateral hole in the outer peripheral wall, there may be used a coating material including the same raw material as that of the honeycomb structure, a ceramic fiber and colloidal oxide as main components (e.g., JP-A-5-269388). The material has a thickness of 1 to 10 mm, preferably 2 to 4 mm, but the thickness may be 1 mm or less, depending on the demanded durability.

[1-5] Other Constitution of Honeycomb Structure:

The honeycomb structure of the present embodiment is formed of a plurality of cells separated from one another by porous partition walls and functioning as flow paths of a fluid.

Moreover, as the shape of the honeycomb structure, examples of the shape of the section of the honeycomb structure perpendicular to the central axis (the shape of the bottom surface) include a circular shape, an elliptic shape, an oblong shape, a polygonal shape such as a quadrangular shape and an irregular shape. The honeycomb structure preferably has a straight-post-like shape including a circular or elliptic section perpendicular to the central axis. The outer shape of this structure is a shape constituted of two circular or elliptic end faces and the outer peripheral surface (the outer peripheral wall side surface) connecting the end faces to each other. In other words, the structure has a cylindrical shape or an elliptic cylindrical. A line connecting the centers of the two circular or elliptic end faces to each other is the central axis.

Moreover, there is not any special restriction on the sectional shape of each cell (the shape of the section perpendicular to the axial direction of the honeycomb structure), and a quadrangular shape is preferable, but a polygonal shape such as a triangular shape or a hexagonal shape may be formed. Moreover, there is not any special restriction on the porosities or the average pore diameter of the partition walls, and the porosity or the average pore diameter of a ceramic material usable for an exhaust gas treatment or the like may be set. There is not any special restriction on the thicknesses of the partition walls. However, when the partition walls have excessively large thicknesses, a thermal capacity excessively increases. When the partition walls have excessively small thicknesses, a mechanical strength sometimes becomes insufficient. The partition walls have thicknesses of preferably 40 to 1000 μm, further preferably 40 to 400 μm. There is not any special restriction on a cell density, but the cell density is in a range of preferably 5 to 300 cells/cm$^2$, further preferably 10 to 200 cells/cm$^2$, especially preferably 30 to 100 cells/cm$^2$.

Specifically, as shown in FIGS. 1A, 2A, 2B and 3, the honeycomb structure 1 includes a plurality of cells 5, and both ends of the structure in the length direction thereof are provided with end faces 2 (2*a*, 2*b*). Moreover, the honeycomb structure 1 is provided with the cells 5 separated from one another by porous partition walls 3 and functioning as fluid flow paths. Furthermore, the honeycomb structure is provided with a sensor plug-in hole 7 into which a sensor can be plugged. It is to be noted that, when such a honeycomb structure is used as a DPF, the fluid flows into one end face (2*a*) and flows out of the other end face (2*b*) of the end faces 2, and additionally the fluid flows from a cell to the adjacent cells through the porous partition walls 3.

More preferably, the honeycomb structure of the present embodiment is made of the ceramic material. Further preferably, the ceramic material is at least one selected from the group consisting of cordierite, silicon carbide, alumina, mullite, aluminum titanate and silicon nitride. From the viewpoints of strength, thermal resistance and the like, the honeycomb structure is preferably formed of the above material.

Moreover, the honeycomb structure is preferably made of a metal foil or a sintered metal. This material can preferably be used instead of a ceramic material such as cordierite.

Examples of the forming method of the honeycomb structure include an extrusion forming method, an injection forming method, a press forming method, and a method of forming the ceramic material into a columnar shape and then forming through holes (the cells), but the extrusion forming method is preferable in that continuous forming is easily performed and that cordierite crystals can be oriented to obtain low thermal expansion properties. Moreover, the extrusion forming may be performed in any direction such as a lateral (horizontal) direction, a longitudinal (vertical) direction or an oblique direction. The extrusion forming can be performed by using, for example, a ram type extrusion forming machine, a biaxial screw type continuous extrusion forming device or the like. To perform the extrusion forming, a die having desired cell shape, partition wall thicknesses and cell density can be used to prepare a formed honeycomb article having a desired honeycomb structure.

Moreover, in the above embodiments, there have been described the integrally formed honeycomb structure in which the partition walls for separating the cells from one another are formed integrally with the outer wall and the honeycomb structure in which the outer wall is separately formed on the outer peripheral portions of the partition walls. However, the present invention can be applied even to a honeycomb structure having a segment structure.

[1-5-1] Plugging Portions:

When the honeycomb structure is used as a diesel particulate filter (DPF), plugging portions (closing portions) are preferably provided.

In a case where each plugging portion has a quadrangular section perpendicular to a cell axial direction, the plugging portion is preferably arranged in each cell opening end so as to alternately arrange the predetermined cells and the remaining cells.

[1-6] Sensor:

Examples of the sensor which can be plugged into the honeycomb structure of the present embodiment include an oxygen sensor, an $NO_X$ sensor, an HC sensor and a temperature sensor. When such a sensor is used, for example, an oxygen concentration, an $NO_X$ concentration or the like required for an OBD system can be measured, and honeycomb control management can be achieved. However, the sensor attachable to the honeycomb structure of the present embodiment is not limited to the above sensor, and needless to say, various sensors can be attached in accordance with a measurement purpose or the like as long as the sensors can be plugged (attached).

As a sensor detaching/attaching method, screwing is usually performed, but the method is not limited to the screwing, and a known detaching/attaching means or a known detaching/attaching method may be used as long as the effect of the present invention is not disturbed.

It is to be noted that the above sensor is connected to a computer for engine control, and a fuel injection amount is controlled in accordance with an output signal from the sensor to perform exhaust gas control.

EXAMPLES

Hereinafter, the present invention will further specifically be described in accordance with examples, but the present invention is not limited to the examples. It is to be noted that "parts" and "%" in the following examples and comparative examples are parts by mass and mass % unless otherwise specified. Moreover, various evaluation and measurement in the examples are performed by the following methods.

[1-1] Measurement of Excess Air Ratio (λ):

The excess air ratio (λ) of an exhaust gas was measured to perform evaluation. Specifically, the gas was analyzed by using a 2000 cc four-cylinder gasoline engine, and the maximum deviation of the excess air ratio (λ) of the exhaust gas was measured. It is to be noted that an engine output is absorbed by a dynamometer (not shown).

[1-2] Gas Analysis:

As the measurement for the gas analysis, an air-fuel ratio sensor made of an oxygen ion conducting solid electrolyte was used during the measurement. Examples of such an air-fuel ratio sensor include sensors disclosed in JP-A-3-167467 and JP-A-61-194345.

[2] Computer for Engine Control:

The valve opening time of a fuel injector was not set to a uniform time for the four cylinders, two of them were brought into a usual fuel injection state, the time for one of the two remaining cylinders was set to a time longer than that of the usual state, and the time for the other remaining cylinder was set to a time shorter than that of the usual state to set the computer for engine control so that the excess air ratios (λ) of the exhaust gas at outlets of the cylinders were −0.08 (a rich direction) and +0.08 (a lean direction). Specifically, the computer was set so that the injection amount of the first cylinder was set to an amount of −0.08λ from a reference injection amount, the injection amounts of the second and third cylinder were set to the reference injection amount, and the injection amount of the fourth cylinder was set to an amount of +0.08λ from the reference injection amount.

It is to be noted that, in an engine, to eliminate the influence of the amount of an EGR gas, an EGR pipe was closed so that the EGR gas did not flow, thereby performing an experiment.

[3] Measurement of Isostatic Strength Ratio:

In conformity to JASO standard M505-87 as the automotive standard issued by Society of Automotive Engineers of Japan, the isostatic strength of a honeycomb structure which had an equal wall thickness, an equal cell number, an equal honeycomb diameter, an equal honeycomb length and an equal sensor plug-in hole depth (an equal sensor plug-in hole length) and which did not have any deep hole or any lateral hole was set to 100, and a ratio with respect to the strength was indicated. It is to be noted that a rubber stopper having an appropriate size and an appropriate hardness was attached to the sensor hole during the measurement.

[4] Measurement of Angle between Deep Hole and Lateral Hole:

A protractor was attached to a jig, and holes were made so as to obtain a desired angle shown in Table 1.

Figure 10:
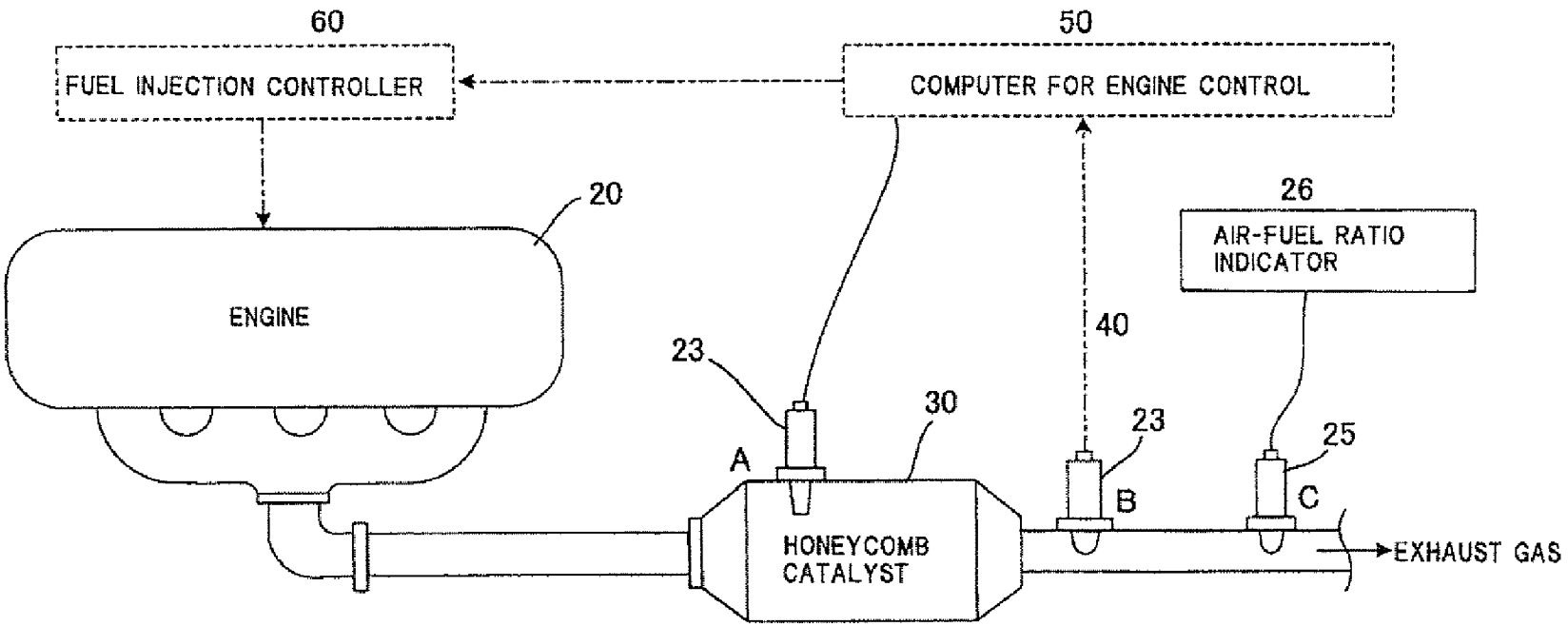
FIG. 10 is a diagram schematically showing the honeycomb structure as the embodiment of the present invention, and an equipment, a set, a flow and the like for use in the experiment of honeycomb structures for use in a comparative example and a reference example.

[5] Procedure:

First, as shown in FIG. 10, an oxygen sensor 23 for engine control was set to a measurement region B positioned on the downstream side of a honeycomb catalyst 30 which carried a catalyst metal in a honeycomb according to Examples 1 to 15, and Comparative Examples 1 to 6 described later, to operate an engine 20 (Reference Examples 1, 2). In this state, by an air-fuel ratio sensor 25 set to a measurement region C on the downstream side of the measurement region B in an exhaust gas flow path, it was confirmed that the exhaust gas was controlled to λ=1.00. That is, it was confirmed that the exhaust gas was controlled to λ=1 at which a ternary catalyst had the best purification performance in a case where the oxygen sensor 23 for engine control was attached to a honeycomb catalyst downstream position where the exhaust gas was sufficiently mixed. It is to be noted that the air-fuel ratio sensor 25 was connected to an air-fuel ratio indicator.

Next, the oxygen sensor for engine control was detached from the measurement region B and attached to a measurement region A as the original attachment position of the honeycomb catalyst according to Examples 1 to 15 and Comparative Examples 1 to 6 to operate the engine and measure λ.

Figure 11:
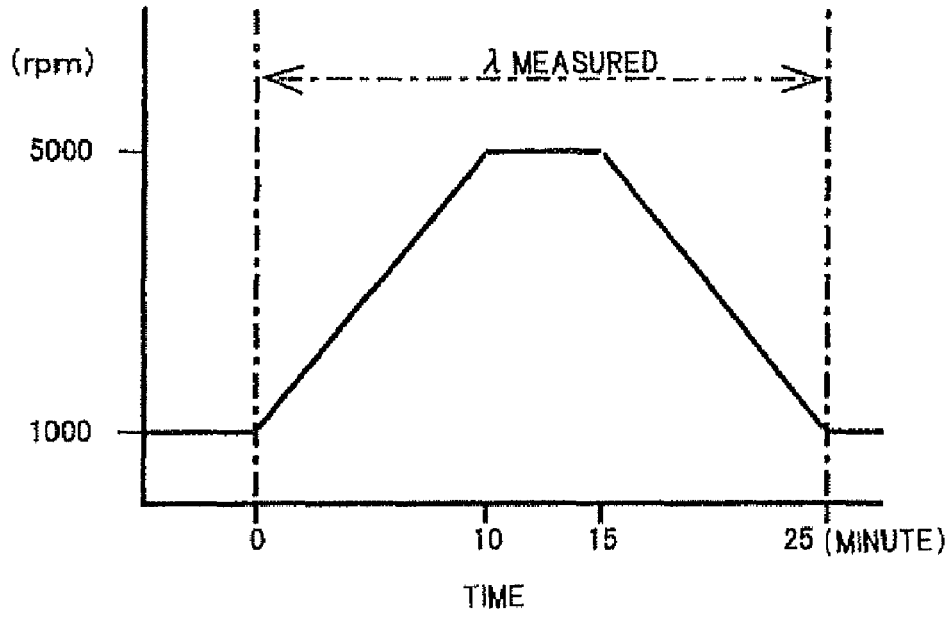
FIG. 11 is a graph showing a relation between an engine rotation number and an excess air ratio (λ) obtained by the experiments.

As engine operation conditions, after warm-up, a torque was set to a predetermined fixed value, and the rotation number was continuously increased from 1000 rpm to 5000 rpm, then held at 5000 rpm for five minutes, and then decreased to 1000 rpm again. Thus, as shown in a graph of FIG. 11, the value λ of the exhaust gas was measured in a range of 1000 rpm to 5000 rpm to 1000 rpm to perform evaluation with the absolute value of deviation from λ=1 at that time. It is to be noted that the ordinate of the graph shown in FIG. 11 indicates the rotation number of the engine, and the abscissa indicates time (minutes).

Moreover, the oxygen sensor for engine control provided with a heater was used (a sufficient operation could be secured even in the position B, and the performance of the sensor hardly changed due to an exhaust gas temperature.

[6] Preparation of Honeycomb Structure:

Example 1

In Example 1, to prepare a honeycomb structure, talc, kaolin and alumina were blended as a material, 6 parts by mass of methyl cellulose as an organic binder, 2.5 parts by mass of a surfactant and 24 parts by mass of water were added to 100 parts by mass of the powder of the material, and the material was uniformly mixed and kneaded to obtain kneaded clay for forming. The resultant kneaded clay was formed by an extrusion forming machine into a honeycomb shape having dimensions of ϕ118×152 mmL after firing, a wall thickness of 0.15 mm, a cell number of 62 (cells/cm$^2$) and a quadrangular cell shape. Afterward, the firing was performed to obtain a cordierite honeycomb structure. Furthermore, a sensor plug-in hole having a hole diameter of 25 mm and a hole depth (a hole length) of 21 mm was formed with a drill in a portion of the outer peripheral surface (the outer peripheral wall side surface) of the honeycomb shape, the portion being 60 mm away from an inlet-side end face of the honeycomb shape, so that the hole had an angle of 90 degrees with respect to a honeycomb central axis. A deep hole having a hole diameter of 10 mm was formed with the drill so that the deep hole communicated with the sensor plug-in hole and so that the deep hole extended to a position of 3 mm from the honeycomb outer peripheral surface (the outer peripheral wall side surface) and did not extend through the honeycomb structure.

Example 2

Kneaded clay for forming was obtained in the same manner as in the honeycomb structure of Example 1, and the clay was formed into a honeycomb shape having dimensions of ϕ118×152 mmL, a wall thickness of 0.075 mm, a cell number of 93 (cells/cm$^2$) and a quadrangular cell shape, followed by firing.

Next, a sensor plug-in hole and a deep hole were formed with a drill in the same manner as in Example 1.

Example 3

Kneaded clay for forming was obtained in the same manner as in the honeycomb structure of Example 1, and the clay was formed into a honeycomb shape having dimensions of ϕ118×152 mmL, a wall thickness of 0.05 mm, a cell number of 140 (cells/cm$^2$) and a quadrangular cell shape, followed by firing. Next, a sensor plug-in hole and a deep hole were formed with a drill in the same manner as in Example 1.

Examples 4 to 6

Kneaded clay for forming was obtained in the same manner as in the honeycomb structure of Example 1, and the resultant kneaded clay was formed into a honeycomb shape having dimensions of ϕ118×152 mmL, a wall thickness of 0.075 mm, a cell number of 93 (cells/cm$^2$) and a quadrangular cell shape by an extrusion forming machine, followed by firing. Thus, three honeycomb structures were prepared. Next, the honeycomb structures were processed as follows: (1) a sensor plug-in hole having a hole diameter of 25 mm and a hole depth (a hole length) of 21 mm was formed with a drill in a portion of the outer peripheral surface (the outer peripheral wall side surface) of the honeycomb shape, the portion being 60 mm away from an inlet-side end face of the honeycomb shape, so that the hole had an angle of 90 degrees with respect to a honeycomb central axis, and a deep hole having a hole diameter of 10 mm was formed with the drill so that the deep hole communicated with the sensor plug-in hole and extended through the honeycomb outer peripheral surface (the outer peripheral wall side surface) (Example 4); (2) the same honeycomb structure as (1) was obtained except that a deep hole diameter was 7.5 mm (Example 5); and (3) the same honeycomb structure as (1) was obtained except that a deep hole diameter was 15 mm (Example 6).

Example 7

A honeycomb structure having dimensions of ϕ118×152 mmL, a wall thickness of 0.075 mm, a cell number of 93 (cells/cm$^2$) and a triangular cell shape was prepared in the same manner as in the honeycomb structure of Example 1. Next, a sensor plug-in hole and a deep hole were formed with a drill in the same manner as in Example 1.

Example 8

Kneaded clay was formed into a honeycomb shape having dimensions of ϕ118×152 mmL, a wall thickness of 0.05 mm, a cell number of 62 (cells/cm$^2$) and a hexagonal cell shape in the same manner as in the honeycomb structure of Example 1. Next, a sensor plug-in hole and a deep hole were formed with a drill in the same manner as in Example 1.

Examples 9 to 11

Three honeycomb structures each having dimensions of ϕ144×152 mmL, a wall thickness of 0.075 mm, a cell number of 93 (cells/cm$^2$) and a quadrangular cell shape were prepared in the same manner as in the honeycomb structure of Example 1. Next, the honeycomb structures were processed as follows: (1) a sensor plug-in hole having a hole diameter of 25 mm and a hole depth (a hole length) of 21 mm was formed with a drill to obtain an angle of 90 degrees with respect to a honeycomb central axis, and a deep hole having a hole diameter of 10 mm was formed with the drill in a portion of the outer peripheral surface (the outer peripheral wall side surface) of the honeycomb shape, the portion being 60 mm away from an inlet-side end face of the honeycomb shape, so that the deep hole communicated with the sensor plug-in hole, extended to a position of 3 mm from a honeycomb outer peripheral surface (the outer peripheral wall side surface) and did not extend through the outer peripheral surface (Example 9); (2) the same honeycomb structure as Example 9 was obtained except that a deep hole diameter was 7.5 mm (Example 10); and (3) the same honeycomb structure as Example 9 was obtained except that a deep hole diameter was 15 mm (Example 11).

Examples 12 to 15

Four honeycomb structures each having dimensions of ϕ118×152 mmL, a wall thickness of 0.075 mm, a cell number of 93 (cells/cm$^2$) and a quadrangular cell shape were prepared in the same manner as in the honeycomb structure of Example 1. Next, sensor plug-in holes were formed with a drill in the same manner as in Example 1, and deep holes were formed so as to communicate with the sensor plug-in holes as follows: (1) the deep hole having a hole diameter of 10 mm was formed with the drill so that the deep hole extended to a position of 3 mm from a honeycomb outer peripheral surface (the outer peripheral wall side surface) and did not extend through the outer peripheral surface, and a lateral hole having a diameter of ϕ10 mm was formed with the drill so that the lateral hole crossed the deep hole at a crossing angle of 90 degrees (Example 12); (2) the deep hole having a hole diameter of 15 mm was formed with the drill so that the deep hole extended to a position of 3 mm from the honeycomb outer peripheral surface (the outer peripheral wall side surface) and did not extend through the outer peripheral surface, and a lateral hole having a diameter of ϕ15 mm was formed with the drill so that the lateral hole crossed the deep hole at a crossing angle of 90 degrees (Example 13); (3) the deep hole having a hole diameter of 10 mm was formed with the drill so that the deep hole extended to a position of 3 mm from the honeycomb outer peripheral surface (the outer peripheral wall side surface) and did not extend through the outer peripheral surface, and a lateral hole having a diameter of ϕ10 mm was formed with the drill so that the lateral hole crossed the deep hole at a crossing angle of 70 degrees (Example 14); and (4) the deep hole having a hole diameter of 10 mm was formed with the drill so that the deep hole extended to a position of 3 mm from the honeycomb outer peripheral surface (the outer peripheral wall side surface) and did not extend through the outer peripheral surface, and a lateral hole having a diameter of ϕ10 mm was formed with the drill so that the lateral hole crossed the deep hole at a crossing angle of 60 degrees (Example 15).

Comparative Examples 1 to 3

In the same manner as in the honeycomb structure of Example 1, honeycomb structures were prepared as follows: (1) the honeycomb structure having dimensions of ϕ118×152 mmL, a wall thickness of 0.15 mm, a cell number of 62 (cells/cm$^2$) and a quadrangular cell shape was obtained (Comparative Example 1); (2) the honeycomb structure having dimensions of ϕ118×152 mmL, a wall thickness of 0.075 mm, a cell number of 93 (cells/cm$^2$) and a quadrangular cell shape was obtained (Comparative Example 2); and (3) the honeycomb structure having dimensions of ϕ118×152 mmL, a wall thickness of 0.05 mm, a cell number of 140 (cells/cm$^2$) and a quadrangular cell shape was obtained (Comparative Example 3). Next, only a sensor plug-in hole having a hole diameter of 25 mm and a hole depth (a hole length) of 21 mm was formed with a drill in a portion of the outer peripheral surface (the outer peripheral wall side surface) of the honeycomb shape of each of (1) to (3), the portion being 60 mm away from an inlet-side end face, so that the sensor plug-in hole had an angle of 90 degrees with respect to a honeycomb central axis.

Comparative Example 4

Knead clay for forming was obtained in the same manner as in the honeycomb structure of Example 1, and the following honeycomb structure was obtained from the resultant clay by an extrusion forming machine: (1) the honeycomb structure having dimensions of ϕ144×152 mmL, a wall thickness of 0.0075 mm, a cell number of 93 (cells/cm$^2$) and a quadrangular cell shape was prepared, Next, only a sensor plug-in hole having a hole diameter of 25 mm and a hole depth (a hole length) of 21 mm was formed with a drill in a portion of the outer peripheral surface (the outer peripheral wall side surface) of the honeycomb shape, the portion being 60 mm away from an inlet-side end face, so that the sensor plug-in hole had an angle of 90 degrees with respect to a honeycomb central axis.

Comparative Examples 5, 6

In the same manner as in the honeycomb structure of Example 1, honeycomb structures were prepared as follows: (1) the honeycomb structure having dimensions of ϕ118×152 mmL, a wall thickness of 0.075 mm, a cell number of 93 (cells/cm$^2$) and a quadrangular cell shape was obtained (Comparative Example 5); and (2) the honeycomb structure having a dimension of ϕ118×152 mmL, a wall thickness of 0.075 mm, a cell number of 93 (cells/cm$^2$) and a quadrangular cell shape was obtained (Comparative Example 6). Next, a sensor plug-in hole having a hole diameter of 25 mm and a hole depth (a hole length) of 21 mm was formed with a drill in a portion of the outer peripheral surface (the outer peripheral wall side surface) of the honeycomb shape of each structure, the portion being 60 mm away from an inlet-side end face, so that the sensor plug-in hole had an angle of 90 degrees with respect to a honeycomb central axis. Next, a deep hole having a hole diameter of 4 mm was formed at the distance away from 60 mm from the end face of the inlet side in the honeycomb shape (1) having dimensions of ϕ118×152 mmL so that the deep hole communicated with the sensor plug-in hole (Comparative Example 5), and a deep hole having a hole diameter of 20 mm was formed at the distance away from 60 mm from the end face of the inlet side in the honeycomb shape (2) having dimensions of ϕ118×152 mmL (Comparative Example 6).

Reference Examples 1, 2

In the same manner as in the honeycomb structure of Example 1, honeycomb structures were prepared as follows: (1) the honeycomb structure having dimensions of +118×152 mmL, a wall thickness of 0.075 mm, a cell number of 93 (cells/cm$^2$) and a quadrangular cell shape was obtained (Reference Example 1); and (2) the honeycomb structure having dimensions of ϕ144×152 mmL, a wall thickness of 0.075 mm, a cell number of 93 (cells/cm$^2$) and a quadrangular cell shape was obtained (Reference Example 2). Next, only a sensor plug-in hole was formed in each honeycomb structure with a drill in the same manner as in Example 1.

Experiment results obtained from Examples 1 to 15, Comparative Examples 1 to 6 and Reference Examples 1, 2 described above are shown in Table 1.

TABLE 1

| | Example 1 | Example 2 | Example 3 | Example 4 | Example 5 | Example 6 | Example 7 | Example 8 | Example 9 | Example 10 |
|---|---|---|---|---|---|---|---|---|---|---|
| Cell shape | Quadrangular | Quadrangular | Quadrangular | Quadrangular | Quadrangular | Quadrangular | Triangular | Hexagonal | Quadrangular | Quadrangular |
| Wall thickness (mm) | 0.15 | 0.075 | 0.05 | 0.075 | 0.075 | 0.075 | 0.075 | 0.05 | 0.075 | 0.075 |
| Cell number (cells/cm$^2$) | 62 | 93 | 140 | 93 | 93 | 93 | 93 | 62 | 93 | 93 |
| Honeycomb diameter (mm) | 118 | 118 | 118 | 118 | 118 | 118 | 118 | 118 | 144 | 144 |
| Honeycomb length (mm) | 152 | 152 | 152 | 152 | 152 | 152 | 152 | 152 | 152 | 152 |
| Sensor hole diameter (mm) | 25 | 25 | 25 | 25 | 25 | 25 | 25 | 25 | 25 | 25 |
| Sensor hole depth (mm) | 21 | 21 | 21 | 21 | 21 | 21 | 21 | 21 | 21 | 21 |
| Deep hole diameter (mm) | 10 | 10 | 10 | 10 | 7.5 | 15 | 10 | 10 | 10 | 7.5 |
| Presence of lateral hole | None | None | None | None | None | None | None | None | None | None |
| Angle (degrees) between deep hole and lateral hole | — | — | — | — | — | — | — | — | — | — |
| Maximum deviation of exhaust gas excess air ratio | <0.01 | <0.01 | 0.01 | <0.01 | 0.02 | <0.01 | <0.01 | <0.01 | 0.01 | 0.02 |
| Isostatic strength ratio* | 98 | 100 | 98 | 96 | 100 | 96 | 100 | 99 | 100 | 100 |

| | Example 11 | Example 12 | Example 13 | Example 14 | Example 15 | Comparative Example 1 |
|---|---|---|---|---|---|---|
| Cell shape | Quadrangular | Quadrangular | Quadrangular | Quadrangular | Quadrangular | Quadrangular |
| Wall thickness (mm) | 0.075 | 0.075 | 0.075 | 0.075 | 0.075 | 0.15 |
| Cell number (cells/cm$^2$) | 93 | 93 | 93 | 93 | 93 | 62 |
| Honeycomb diameter (mm) | 144 | 118 | 118 | 118 | 118 | 118 |
| Honeycomb length (mm) | 152 | 152 | 152 | 152 | 152 | 152 |

TABLE 1-continued

| | | | | | | |
|---|---|---|---|---|---|---|
| Sensor hole diameter (mm) | 25 | 25 | 25 | 25 | 25 | 25 |
| Sensor hole depth (mm) | 21 | 21 | 21 | 21 | 21 | 21 |
| Deep hole diameter (mm) | 15 | 10 | 15 | 10 | 10 | — |
| Presence of lateral hole | None | Present (10ϕ) | Present (15ϕ) | Present (10ϕ) | Present (10ϕ) | None |
| Angle (degrees) between deep hole and lateral hole | — | 90° (Cross at right angles) | 90° (Cross at right angles) | 75° | 60° | — |
| Maximum deviation of exhaust gas excess air ratio | 0.01 | <0.01 | <0.01 | <0.01 | <0.01 | 0.05 |
| Isostatic strength ratio* | 96 | 97 | 95 | 96 | 95 | 100 |

| | Comparative Example 1 | Comparative Example 2 | Comparative Example 3 | Comparative Example 4 | Comparative Example 5 | Comparative Example 6 | Reference Example 1 | Reference Example 2 |
|---|---|---|---|---|---|---|---|---|
| Cell shape | Quad-rangular | Quad-rangular | Quad-rangular | Quad-rangular | Quad-rangular | Quadrangular | Quadrangular | Quadrangular |
| Wall thickness (mm) | 0.15 | 0.075 | 0.05 | 0.075 | 0.075 | 0.075 | 0.075 | 0.075 |
| Cell number (cells/cm$^2$) | 62 | 93 | 140 | 93 | 93 | 93 | 93 | 93 |
| Honeycomb diameter (mm) | 118 | 118 | 118 | 144 | 118 | 118 | 118 | 144 |
| Honeycomb length (mm) | 152 | 152 | 152 | 152 | 152 | 152 | 152 | 152 |
| Sensor hole diameter (mm) | 25 | 25 | 25 | 25 | 25 | 25 | 25 | 25 |
| Sensor hole depth (mm) | 21 | 21 | 21 | 21 | 21 | 21 | 21 | 21 |
| Deep hole diameter (mm) | — | — | — | — | 4 | 20 | — | — |
| Presence of lateral hole | None | None | None | None | None | None | None | None |
| Angle (degrees) between deep hole and lateral hole | — | — | — | — | — | — | — | — |
| Maximum deviation of exhaust gas excess air ratio | 0.05 | 0.05 | 0.06 | 0.07 | 0.05 | <0.01 | <0.01 | <0.01 |
| Isostatic strength ratio* | 100 | 100 | 100 | 100 | 100 | 86 | 100 | 100 |

*The isostatic strength of the honeycomb structure which has an equal wall thickness, an equal cell number, an equal honeycomb diameter, an equal honeycomb length, an equal sensor hole diameter and an equal sensor hole depth and which does not have any deep hole or any lateral hole is set to 100, and a ratio with respect to the strength is indicated.

[Discussion] Assumption:

As described above, it can be confirmed from Reference Examples 1 and 2 that the exhaust gas is controlled to λ=1.00, and it can be confirmed that the exhaust gas is controlled to λ=1, at which a tertiary catalyst has the best purification performance, in a case where the oxygen sensor B for engine control is attached to the downstream position of the honeycomb catalyst, where the exhaust gas is sufficiently mixed.

[Discussion 2]

Next, considering from the result measured by the sensor A, in case of Examples 1 to 15, it is demonstrated that the deviation of λ is not easily generated in the honeycomb structure, and satisfactory results can be obtained. Specifically, in the honeycomb structures of Examples 2, and 7, the maximum deviation of the excess air ratio (λ) of the exhaust gas can be suppressed to <0.01, and the isostatic strength can be set to 100%. Moreover, in the honeycomb structures of Examples 1, 4, 6, 8, 12, 13, 14 and 15, the maximum deviation of the excess air ratio (λ) of the exhaust gas can be suppressed to <0.01, and the lowering of the isostatic strength can be suppressed in a range in which the characteristics of the honeycomb structure are not impaired. Furthermore, in the honeycomb structure of Example 3, 9 and 11, the maximum deviation of the excess air ratio (λ) of the exhaust gas is 0.01. In the honeycomb structures of Examples 5, 10, the maximum deviation of the excess air ratio (λ) of the exhaust gas is 0.02 but can be suppressed in a range in which the precise control of the exhaust gas is not impaired, and the isostatic strength does not lower and can be set to 100%. If the honeycomb structure having a large diameter (sectional area) is used, it is difficult to precisely control the exhaust gas. Even against such a problem, as described above, satisfactory results can be obtained in the honeycomb structures of Examples 9 to 11, where the honeycomb structures having a large diameter are used. Excellent honeycomb structures can be obtained irrespective of the size of the diameter (the sectional area).

[Discussion 3]

On the other hand, in the honeycomb structures of Comparative Examples 1 to 4 each having only a conventional sensor plug-in hole, since any deep hole (any lateral hole) is not provided, an isostatic strength of 100% can be maintained. However, the gases of all the cylinders do not easily reach the oxygen sensor, and the excess air ratio (λ) noticeably deviates. Therefore, it has been ensured that it is difficult to precisely control the exhaust gas. Above all, as seen from the experiment result of the honeycomb structure of Comparative Example 4, it has been ensured that this tendency is remarkable in the honeycomb structure having a large diameter. In Comparative Example 5, since the deep hole has a small diameter of 4 mm, the isostatic strength of 100% can be maintained, but the gases of all the cylinders do not easily reach the oxygen sensor, and the excess air ratio (λ) noticeably deviates. It has been ensured that it is difficult to precisely control the exhaust gas. In Comparative Example 6, since the deep hole has a large diameter of 20 mm, the excess air ratio (λ) deviates only little, but the isostatic strength noticeably lowers to 86%.

The honeycomb structure provided with a sensor insertion hole of the present invention can preferably be used in a filter provided with a catalyst for exhaust gas, and for a treatment of exhaust gas from a diesel engine, an automobile, a track, a bus engine or a combustion device.

What is claimed is:

1. A honeycomb structure which is formed by a plurality of cells separated from one another by porous partition walls and functioning as fluid flow paths, the honeycomb structure comprising:

a sensor plug-in hole which is formed in an outer peripheral surface of the honeycomb structure and into which a sensor can be plugged, the sensor plug-in hole penetrating one or more passages; and at least one deep hole which communicates with the sensor plug-in hole and penetrates a greater number of passages than the sensor plug-in hole.

2. The honeycomb structure according to claim 1, further comprising:

at least one lateral hole crossing the at least one deep hole.

3. The honeycomb structure according to claim 2, wherein a diameter of the at least one lateral hole is twice or more as large as a cell pitch and is 60% or less of an average diameter of the sensor plug-in hole.

4. The honeycomb structure according to claim 2, wherein the at least one deep hole is provided to cross the at least one lateral hole at right angles.

5. The honeycomb structure according to claim 3, wherein the at least one deep hole is provided to cross the at least one lateral hole at right angles.

6. The honeycomb structure according to claim 2, wherein the at least one deep hole includes a first end that communicates with the sensor plug-in hole and a second end that does not communicate with the sensor plug-in hole, the second end of the at least one deep hole and at least one end of the at least one lateral hole being closed in a vicinity of an outer peripheral wall of the honeycomb structure.

7. The honeycomb structure according to claim 3, wherein the at least one deep hole includes a first end that communicates with the sensor plug-in hole and a second end that does not communicate with the sensor plug-in hole, the second end of the at least one deep hole and at least one end of the lateral hole being closed in a vicinity of an outer peripheral wall of the honeycomb structure.

8. The honeycomb structure according to claim 4, wherein the at least one deep hole includes a first end that communicates with the sensor plug-in hole and a second end that does not communicate with the sensor plug-in hole, the second end of the at least one deep hole and at least one end of the at least one lateral hole being closed in a vicinity of an outer peripheral wall of the honeycomb structure.

9. The honeycomb structure according to claim 5, wherein the at least one deep hole includes a first end that communicates with the sensor plug-in hole and a second end that does not communicate with the sensor plug-in hole, the second end of the at least one deep hole and at least one end of the at least one lateral hole being closed in a vicinity of an outer peripheral wall of the honeycomb structure.

10. The honeycomb structure according to claim 1, which is made of a ceramic material.

11. The honeycomb structure according to claim 10, wherein the ceramic material is at least one selected from the group consisting of cordierite, silicon carbide, alumina, mullite, aluminum titanate and silicon nitride.

12. The honeycomb structure according to claim 1, which is made of a metal foil or a sintered metal.

13. The honeycomb structure according to claim 1, wherein a diameter of the at least one deep hole is twice or more as large as a cell pitch and is 60% or less of an average diameter of the sensor plug-in hole.

* * * * *